US010909794B2

(12) United States Patent
Nada

(10) Patent No.: US 10,909,794 B2
(45) Date of Patent: Feb. 2, 2021

(54) MONEY PROCESSING DEVICE

(71) Applicant: GLORY LTD., Hyogo (JP)

(72) Inventor: Keisuke Nada, Hyogo (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 16/636,409

(22) PCT Filed: Aug. 8, 2018

(86) PCT No.: PCT/JP2018/029766
§ 371 (c)(1),
(2) Date: Feb. 4, 2020

(87) PCT Pub. No.: WO2019/031544
PCT Pub. Date: Feb. 14, 2019

(65) Prior Publication Data

US 2020/0175801 A1 Jun. 4, 2020

(30) Foreign Application Priority Data

Aug. 10, 2017 (JP) ..... 2017-155220

(51) Int. Cl.

| | |
|---|---|
| ***G07D 11/237*** | (2019.01) |
| ***G07D 11/50*** | (2019.01) |
| ***G07D 11/18*** | (2019.01) |
| ***G07D 11/13*** | (2019.01) |
| ***G07D 11/30*** | (2019.01) |

(52) U.S. Cl.
CPC ..... *G07D 11/237* (2019.01); *G07D 11/13* (2019.01); *G07D 11/18* (2019.01); *G07D 11/30* (2019.01); *G07D 11/50* (2019.01)

(58) Field of Classification Search
None
See application file for complete search history.

(56) References Cited

U.S. PATENT DOCUMENTS

2002/0107800 A1 8/2002 Kadowaki et al.
2010/0245043 A1 9/2010 Doi et al.
(Continued)

FOREIGN PATENT DOCUMENTS

JP 2002-197516 7/2002
JP 2013-12127 1/2013
(Continued)

OTHER PUBLICATIONS

International Search Report issued in International Patent Application No. PCT/JP2018/029766, dated Nov. 6, 2018.
(Continued)

*Primary Examiner* — Kristy A Haupt
(74) *Attorney, Agent, or Firm* — Greenblum & Bernstein, P.L.C.

(57) ABSTRACT

A money processing device includes a storage that stores and feeds money, a path that transports the money fed from the storage, recognition circuitry that recognizes a denomination of the money transported by the path, and processing circuitry configured to output information on a storage abnormality of the storage based on information on wrong denomination money. The wrong denomination money is money whose denomination recognized by the recognition circuitry does not match a set denomination assigned to the storage as the denomination of money that is supposed to be stored in the storage.

13 Claims, 8 Drawing Sheets

(56) References Cited

U.S. PATENT DOCUMENTS

| | | | |
|---|---|---|---|
| 2013/0001040 | A1 | 1/2013 | Iwamura et al. |
| 2015/0076223 | A1 | 3/2015 | Graef et al. |
| 2017/0193731 | A1 | 7/2017 | Kim et al. |

FOREIGN PATENT DOCUMENTS

| | | |
|---|---|---|
| JP | 2014-85783 | 5/2014 |
| JP | 2014-139846 | 7/2014 |
| JP | 2014-182431 | 9/2014 |
| JP | 2015-022413 A | 2/2015 |
| JP | 2017-62750 | 3/2017 |

OTHER PUBLICATIONS

International Preliminary Report on Patentability issued in International Patent Application No. PCT/JP2018/029766, dated Feb. 11, 2020.

The Extended European Search Report, European Patent Office, Application No. 18844469.9, dated Jun. 15, 2020.

RECONCILIATION PROCESS (PRIMARY TRANSPORT)

RECONCILIATION PROCESS (SECONDARY TRANSPORT)

WITHDRAWAL PROCESS

COLLECTION PROCESS

MONEY PROCESSING DEVICE

TECHNICAL FIELD

The technology disclosed herein relates to money processing devices.

BACKGROUND ART

Conventionally, money processing devices for processing money are known in the art. For example, Patent Document 1 discloses a banknote processing device including a storage unit configured to store banknotes and feed banknotes stored therein, a recognition unit, and a control unit. This banknote processing device performs various processes such as a withdrawal process, a collection process, and a reconciliation process.

CITATION LIST

Patent Document

PATENT DOCUMENT 1: Japanese Unexamined Patent Publication No. 2013-12127

SUMMARY OF THE INVENTION

Technical Problem

In the money processing device of Patent Document 1, when, for example, staff manually loads the storage unit with money, he or she may load the storage unit with money of a denomination different from the denomination of money that is supposed to be stored in the storage unit and therefore a storage abnormal (an abnormality in which the denomination of a part or all of the pieces of money stored in the storage unit does not match the denomination of money that is supposed to be stored in the storage unit) may occur in the storage unit. In the money processing device of Patent Document 1, however, such a storage abnormality cannot be verified.

It is an object of the technique disclosed herein to provide a money processing device capable of verifying a storage abnormality, namely an abnormality in which the denomination of a part or all of the pieces of money stored in a storage unit does not match the denomination of money that is supposed to be stored in the storage unit.

Solution to the Problem

The technique disclosed herein relates to a money processing device. The money processing device includes: a storage unit that stores and feeds money; a transport unit that transports the money fed from the storage unit; a recognition unit that recognizes a denomination of the money transported by the transport unit; and a control unit that outputs information on a storage abnormality of the storage unit based on information on wrong denomination money, the wrong denomination money being money whose denomination recognized by the recognition unit does not match a set denomination assigned to the storage unit as a denomination of money that is supposed to be stored in the storage unit.

With the above configuration, the information on the storage abnormality of the storage unit is output based on the information on the wrong denomination money. The storage abnormality, namely the abnormality in which the denomination of a part or all of the pieces of money stored in the storage unit does not match the denomination of money that is supposed to be stored in the storage unit, can thus be verified.

The information on the wrong denomination money may include information on the number of pieces of the wrong denomination money.

With the above configuration, the information on the storage abnormality of the storage unit can be output based on the number of pieces of the wrong denomination money.

The control unit may be configured to output the information on the storage abnormality of the storage unit when the number of pieces of the wrong denomination money is larger than a predetermined threshold.

With the above configuration, when the storage abnormality has occurred in the storage unit, there are a large number of pieces of the wrong denomination money. Accordingly, by outputting the information on the storage abnormality of the storage unit when the number of pieces of the wrong denomination money is larger than the predetermined threshold, the information on the storage abnormality of the storage unit can be appropriately output according to the number of pieces of the wrong denomination money.

The threshold may be set to a value according to storage capacity of a transport destination of the wrong denomination money.

With the above configuration, the information on the storage abnormality of the storage unit can be output when the number of pieces of the wrong denomination money is larger than the value according to the storage capacity of the transport destination of the wrong denomination money. If the wrong denomination money continues to be transported to the transport destination even though the storage abnormality has occurred in the storage unit, an error stop may occur due to the presence of a large number of pieces of wrong denomination money. For example, a large number of pieces of wrong denomination money are transported and the transport destination of the wrong denomination money becomes full, whereby the transport of the money in the money processing device may be stopped. Accordingly, such an error stop due to the presence of a large number of pieces of the wrong denomination money can be prevented by comparing the number of pieces of the wrong denomination money with the value according to the storage capacity of the transport destination of the wrong denomination money and outputting the information on the storage abnormality of the storage unit.

The threshold may be set to a value according to the total number of pieces of the money fed from the storage unit.

With the above configuration, the information on the storage abnormality of the storage unit can be output when the number of pieces of the wrong denomination money is larger than the value according to the total number of pieces of the money fed from the storage unit. When the storage abnormality has occurred in the storage unit, the ratio of the number of pieces of the wrong denomination money to the total number of pieces of the money fed from the storage unit tends to be relatively high. Accordingly, by comparing the number of pieces of the wrong denomination money with the value according to the total number of pieces of money fed from the storage unit and outputting the information on the storage abnormality of the storage unit, the information on the storage abnormality of the storage unit can be appropriately output according to the number of pieces of the wrong denomination money.

The information on the storage abnormality of the storage unit may include information on the set denomination.

With the above configuration, the set denomination of the storage unit as well as the storage abnormality of the storage unit can be verified. The set denomination of the storage unit is the denomination of money that is supposed to be stored in the storage unit.

The information on the storage abnormality of the storage unit may include information on the denomination of the wrong denomination money.

With the above configuration, the denomination of the wrong denomination money as well as the storage abnormality of the storage unit can be verified.

The money processing device may further include: a wrong denomination storage unit that stores the wrong denomination money. The control unit may be configured so that, in a reconciliation process in which the money fed from the storage unit is recognized by the recognition unit, the control unit controls the transport unit so that the wrong denomination money is transported to the wrong denomination storage unit.

With the above configuration, the wrong denomination money out of the money that is processed in the reconciliation process can be stored in the wrong denomination storage unit. Since the information on the storage abnormality of the storage unit can be output in the reconciliation process, the storage abnormality of the storage unit can be verified in the reconciliation process.

The money processing device may further include: a wrong denomination storage unit that stores the wrong denomination money; and a withdrawal unit that dispenses the money to be withdrawn. The control unit may be configured so that, in a withdrawal process in which the money fed from the storage unit is recognized by the recognition unit and transported to the withdrawal unit according to the recognition result of the recognition unit, the control unit controls the transport unit so that the wrong denomination money is transported to the wrong denomination storage unit.

With the above configuration, the wrong denomination money out of the money that is processed in the withdrawal process can be stored in the wrong denomination storage unit. Since the information on the storage abnormality of the storage unit can be output in the withdrawal process, the storage abnormality of the storage unit can be verified in the withdrawal process.

The money processing device may further include: a wrong denomination storage unit that stores the wrong denomination money; and a collection storage unit that stores the money to be collected. In a collection process in which the money fed from the storage unit is recognized by the recognition unit and transported to the collection storage unit according to the recognition result of the recognition unit, the control unit may control the transport unit so that the wrong denomination money is transported to the wrong denomination storage unit.

With the above configuration, the wrong denomination money out of the money that is processed in the collection process can be stored in the wrong denomination storage unit. Since the information on the storage abnormality of the storage unit can be output in the collection process, the storage abnormality of the storage unit can be verified in the collection process.

The money processing device may further include: a wrong denomination storage unit that stores the wrong denomination money; and a load storage unit that is loaded with the money. The control unit may be configured so that, in a loading process in which the money fed from the storage unit is recognized by the recognition unit and transported to the load storage unit according to the recognition result of the recognition unit, the control unit controls the transport unit so that the wrong denomination money is transported to the wrong denomination storage unit.

With the above configuration, the wrong denomination money out of the money that is processed in the loading process can be stored in the wrong denomination storage unit. Since the information on the storage abnormality of the storage unit can be output in the loading process, the storage abnormality of the storage unit can be verified in the loading process.

The control unit may be configured so that, when the control unit outputs the information on the storage abnormality of the storage unit, the control unit controls the transport unit so that the wrong denomination money fed from the wrong denomination storage unit returns to the storage unit.

With the above configuration, the wrong denomination money stored in the wrong denomination storage unit can be returned to the storage unit.

The money processing device may further include: a dispense unit that dispenses the money. The control unit may be configured so that, when the control unit outputs the information on the storage abnormality of the storage unit, the control unit controls the transport unit so that the wrong denomination money fed from the wrong denomination storage unit is transported to the dispense unit.

With the above configuration, the wrong denomination money stored in the wrong denomination storage unit can be dispensed from the dispense unit to the outside of the money processing device.

The control unit may be configured so that, when the control unit outputs the information on the storage abnormality of the storage unit, the control unit changes the set denomination assigned to the storage unit to the denomination of the wrong denomination money.

With the above configuration, by changing the set denomination assigned to the storage unit to the denomination of the wrong denomination money, the denomination of the money stored in the storage unit can be made to match the denomination of money that is supposed to be stored in the storage unit. This eliminates the storage abnormality of the storage unit.

Advantages of the Invention

As described above, a storage abnormality, namely an abnormality in which the denomination of a part or all of the pieces of money stored in the storage unit does not match the denomination of money that is supposed to be stored in the storage unit, can be verified.

DESCRIPTION OF EMBODIMENTS

Figure 1:
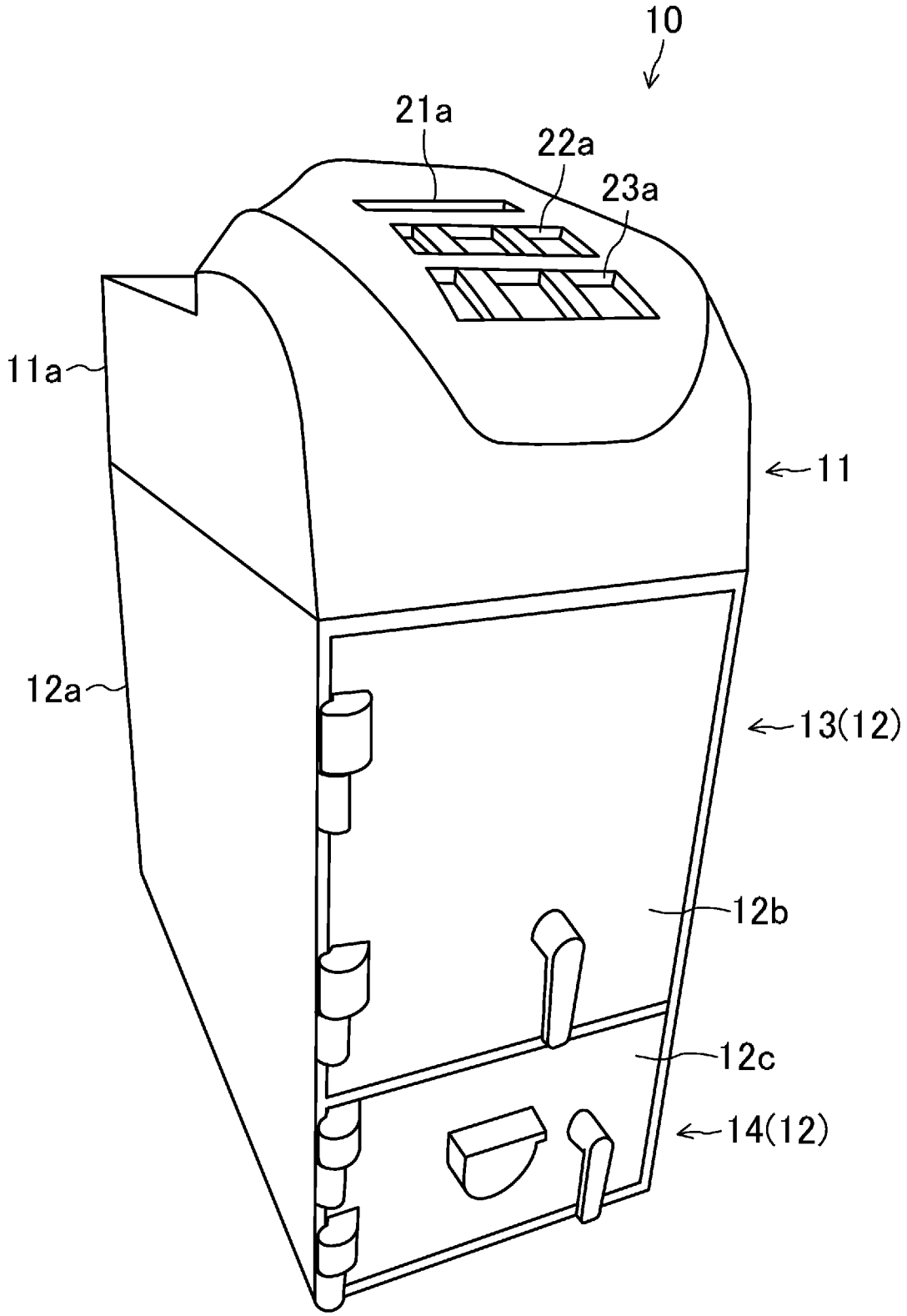
FIG. 1 is a perspective view illustrating the external appearance of a money processing device according to an embodiment.

An embodiment will be described in detail below with reference to the accompanying drawings. The same or corresponding portions are denoted with the same reference characters throughout the figures, and description thereof will not be repeated.

(Money Processing Device)

Figure 2:
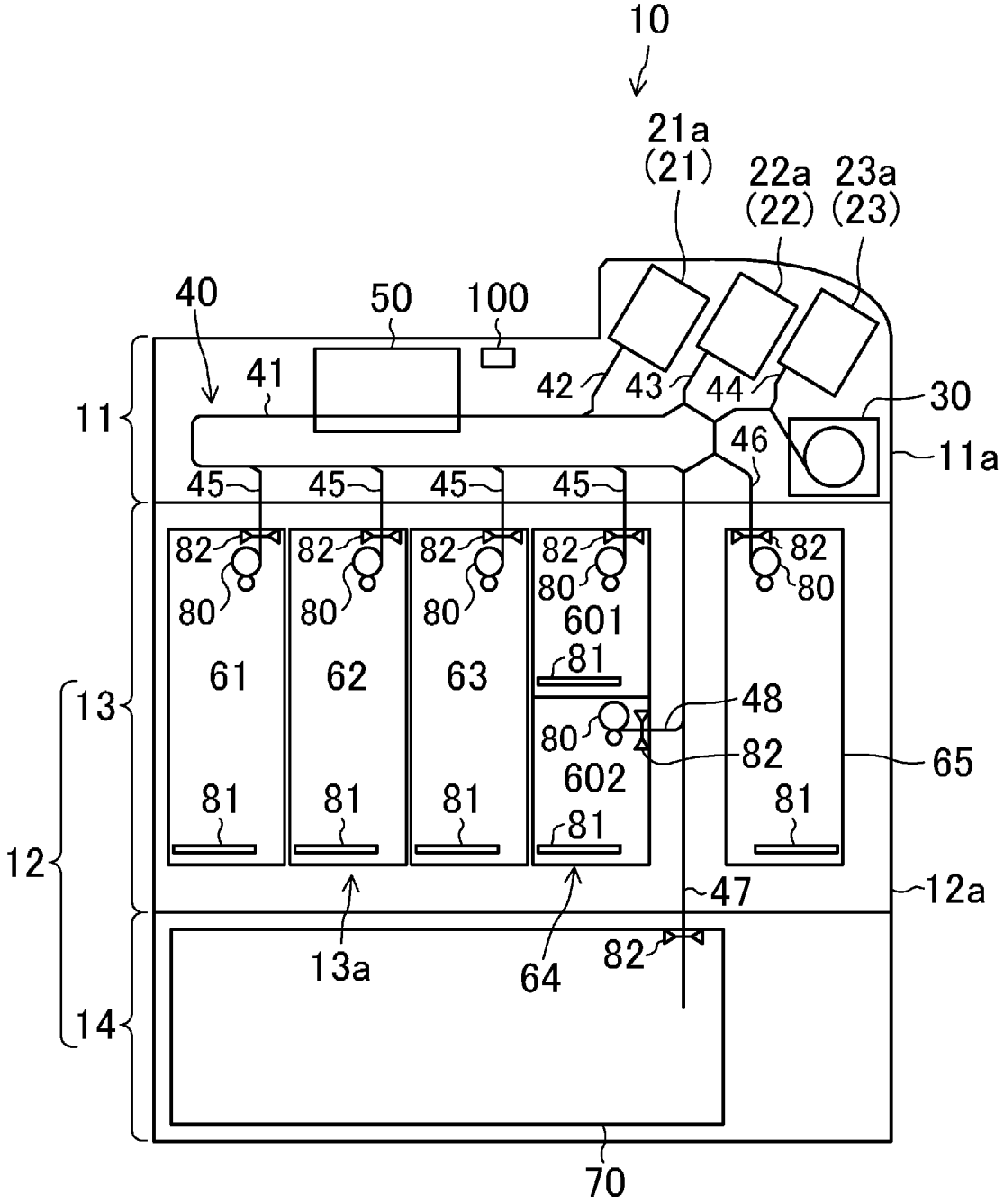
FIG. 2 is a sectional view illustrating the configuration of the money processing device according to the embodiment.

FIGS. 1 and 2 illustrate the appearance and configuration of a money processing device 10 according to the embodiment. In this example, the money processing device 10 is configured to process banknotes as an example of money. For example, the money processing device 10 is located on a bank teller counter, and two tellers on both sides of the money processing device 10 share the money processing device 10. The money processing device 10 includes a processing unit 11 and a safe unit 12.

Processing Unit

The processing unit 11 includes a processing unit housing 11*a*, a deposit unit 21, a first withdrawal unit 22, a second withdrawal unit 23, a temporary storage unit 30, a transport unit 40, and a recognition unit 50. The processing unit housing 11*a* accommodates the deposit unit 21, the first withdrawal unit 22, the second withdrawal unit 23, the temporary storage unit 30, the transport unit 40, and the recognition unit 50.

Safe Unit

The safe unit 12 includes a protective housing 12*a*. The protective housing 12*a* has a first door 12*b* and a second door 12*c* on its front side. The safe unit 12 is divided into a first safe unit 13 corresponding to the first door 12*b* and a second safe unit 14 corresponding to the second door 12*c*. The first safe unit 13 forms the upper part of the safe unit 12, and the second safe unit 14 forms the lower part of the safe unit 12.

First Safe Unit

The first safe unit 13 includes one or more storage cassettes and a reconciliation cassette 65. In this example, the first safe unit 13 includes first to fourth storage cassettes 61 to 64. The first to fourth storage cassettes 61 to 64 and the reconciliation cassette 65 are disposed next to each other in the depth direction of the money processing device 10 (the horizontal direction in FIG. 2). The fourth storage cassette 64 is divided into an upper cassette portion 601 and a lower cassette portion 602.

In this example, the first to fourth storage cassettes 61 to 64 and the reconciliation cassette 65 are detachable from the money processing device 10. Specifically, the first safe unit 13 has a slide storage unit 13*a* that can be pulled out forward from the money processing device 10, and the first to fourth storage cassettes 61 to 64 and the reconciliation cassette 65 are detachable from the slide storage unit 13*a*. With this configuration, when the first door 12*b* of the first safe unit 13 is opened, the slide storage unit 13*a* can be pulled out forward from the money processing device 10 and the first to fourth storage cassettes 61 to 64 can be attached to and detached from the slide storage unit 13*a*.

The reconciliation cassette 65 may not be detachable from the slide storage unit 13*a*. The reconciliation cassette 65 may be detachable from other part of the first safe unit 13 which is different from the slide storage unit 13*a*, or may be detachable from other part of the money processing device 10 which is different from the first safe unit 13. For example, the reconciliation cassette 65 may be detachable from the processing unit 11.

Second Safe Unit

The second safe unit 14 includes a collection cassette 70. In this example, the collection cassette 70 is detachable from the second safe unit 14.

Deposit Unit

The deposit unit 21 is configured so that banknotes are placed therein. Specifically, the deposit unit 21 has a deposit port 21*a* that opens upward in the upper surface of the processing unit housing 11*a*, and the deposit unit 21 is configured so that it can accept a plurality of banknotes at a time. The deposit unit 21 is provided with a feed mechanism (not shown) that feeds the plurality of banknotes placed in the deposit unit 21 one by one to the transport unit 40.

First Withdrawal Unit

The first withdrawal unit 22 is configured to dispense banknotes. Specifically, the first withdrawal unit 22 has a first withdrawal port 22*a* that is formed in front of (in FIG. 2, on the right side of) the deposit port 21*a* in the area from the upper surface to the front surface of the processing unit housing 11*a*. The first withdrawal unit 22 is configured so that it can hold a plurality of banknotes at a time.

Second Withdrawal Unit

The second withdrawal unit 23 is configured to dispense banknotes. Specifically, the second withdrawal unit 23 has a second withdrawal port 23*a* that is formed in front of (in FIG. 2, on the right side of) the first withdrawal port 22*a* in the area from the upper surface to the front surface of the processing unit housing 11*a*. The second withdrawal unit 23 is configured so that it can hold a plurality of banknotes at a time.

Temporary Storage Unit

The temporary storage unit 30 is configured to temporarily store banknotes. Namely, the temporary storage unit 30 is configured to store and feed banknotes. In this example, the temporary storage unit 30 is configured to take up and store banknotes one by one and feed the banknotes one by one in reverse order. The temporary storage unit 30 thus stores and feeds banknotes on what is called a first-in last-out basis. That is, the temporary storage unit 30 is of a take-up type. The temporary storage unit 30 may be configured to stack and store a plurality of banknotes in the vertical or horizontal direction. That is, the temporary storage unit 30 may be of a stack type.

For example, the temporary storage unit 30 may be used to temporarily store banknotes placed in the deposit unit 21 in a deposit process of the money processing device 10. In the money processing device 10, the temporary storage unit 30 is also used for other applications different from the above application. The applications of the temporary storage unit 30 will be described later in detail.

Transport Unit

The transport unit 40 is connected to each part of the money processing device 10 and is configured to transport banknotes. In this example, the transport unit 40 is connected to the deposit unit 21, the first withdrawal unit 22, the second withdrawal unit 23, the temporary storage unit 30, the first to fourth storage cassette 61 to 64, the reconciliation cassette 65, and the collection cassette 70. For example, the transport unit 40 transports money fed from a storage unit that stores and feeds banknotes. For example, the transport unit 40 transports money fed from the first storage cassette 61 that is an example of the storage unit.

In this example, the transport unit 40 includes a loop transport path 41, an input path 42, a first dispensing path 43, a second dispensing path 44, one or more storage paths 45, a first connection path 46, a second connection path 47, and a branch path 48. The loop transport path 41 has an annular shape. The input path 42, the first dispensing path 43, and the second dispensing path 44 extend from the loop transport path 41 toward the deposit unit 21, the first withdrawal unit 22, and the second withdrawal unit 23, respectively. The temporary storage unit 30 is connected to an intermediate portion of the second dispensing path 44. The four storage paths 45 extend from the loop transport path 41 toward the first storage cassette 61, the second storage cassette 62, the third storage cassette 63, and the upper cassette portion 601 of the fourth storage cassette 64, respectively. The first connection path 46 and the second connection path 47 extend from the loop transport path 41 toward the reconciliation cassette 65 and the collection cassette 70, respectively. The branch path 48 extends from an intermediate portion of the second connection path 47 toward the lower cassette portion 602 of the fourth storage cassette 64. These transport paths are formed by a transport belt for transporting banknotes, a drive mechanism for driving the transport belt, a guide mechanism for guiding transport of banknotes, and a branch mechanism for switching the direction in which banknotes are transported.

Recognition Unit

The recognition unit 50 is configured to recognize banknotes. In this example, the recognition unit 50 is provided in the loop transport path 41 of the transport unit 40 and is configured to recognize the denominations of banknotes that are transported by the transport unit 40. The recognition unit 50 may be configured to recognize the authenticity, fitness, etc. of banknotes in addition to their denominations. The recognition unit 50 may be configured to recognize the transport state of banknotes. For example, the recognition unit 50 is formed by various sensors such as a line sensor, a magnetic sensor, and an image sensor, an arithmetic processing unit such as a CPU, a storage unit such as a memory storing a program and information for operating the arithmetic processing unit, etc.

Storage Cassette

The first storage cassette 61 is configured to store and feed banknotes. In this example, the first storage cassette 61 is of a stack type in which a plurality of banknotes are stacked and stored in the vertical direction. The first storage cassette 61 is also of a cassette type that is in the shape of a vertically elongated rectangular parallelepiped and is detachable from the slide storage unit 13*a* of the money processing device 10.

Specifically, the first storage cassette 61 has an inlet/outlet port in its upper surface through which banknotes are passed. The storage path 45 of the transport unit 40 is connected to the inlet/outlet port. A feed-in/feed-out mechanism 80 is provided near the inlet/outlet port of the first storage cassette 61. The feed-in/feed-out mechanism 80 is configured to feed banknotes from the transport unit 40 one by one to the first storage cassette 61 and feed banknotes from the first storage cassette 61 one by one to the transport unit 40. A stacking platform 81 is provided in the first storage cassette 61. The stacking platform 81 is configured to move up and down according to the amount of banknotes stacked in the first storage cassette 61. That is, the stacking platform 81 moves down as the amount of banknotes stacked in the first storage cassette 61 increases. With this configuration, banknotes fed from the transport unit 40 into the first storage cassette 61 are stacked in order on the stacking platform 81. The banknotes stacked on stacking platform 81 are sequentially fed from the first storage cassette 61 to the transport unit 40 from top to bottom. That is, the first storage cassette 61 is configured to receive and feed banknotes from and to the transport unit 40.

The first storage cassette 61 is provided with a passage sensor 82. The passage sensor 82 is mounted in the inlet/outlet port of the first storage cassette 61 and is configured to detect passage of banknotes through the inlet/outlet port of the first storage cassette 61. Specifically, the passage sensor 82 has a transmitting unit that transmits light and a receiving unit that receives light. The passage sensor 82 is mounted so that light is blocked by a banknote passing through the inlet/outlet port of the first storage cassette 61. The passage sensor 82 is configured to detect passage of a banknote when light is blocked.

The second storage cassette 62 and the third storage cassette 63 have a configuration similar to that of the first storage cassette 61. The second storage cassette 62 and the third storage cassette 63 are also provided with the feed-in/feed-out mechanism 80, the stacking platform 81, and the passage sensor 82.

The fourth storage cassette 64 is divided into upper and lower parts by a partition wall. The upper part is the upper cassette portion 601, and the lower part is the lower cassette portion 602. The upper cassette portion 601 has an inlet/outlet port in its upper surface through which banknotes are passed. The storage path 45 of the transport unit 40 is connected to this inlet/outlet port. The lower cassette portion 602 has an inlet/outlet port in the upper part of its side surface through which banknotes are passed. The branch path 48 of the transport unit 40 is connected to this inlet/outlet port. Like the first storage cassette 61, the upper cassette portion 601 and the lower cassette portion 602 are also provided with the feed-in/feed-out mechanism 80, the stacking platform 81, and the passage sensor 82. That is, like the first storage cassette 61, the upper cassette portion 601 and the lower cassette portion 602 are configured to store and feed banknotes and to receive and feed banknotes to and from the transport unit 40.

Reconciliation Cassette

The reconciliation cassette 65 is configured to store and feed banknotes. In this example, the reconciliation cassette 65 is of a stack type in which a plurality of banknotes are stacked and stored in the vertical direction. The reconciliation cassette 65 is of a cassette type that is in the shape of a vertically elongated rectangular parallelepiped and is detachable from the slide storage unit 13*a* of the money processing device 10.

Specifically, the reconciliation cassette 65 also has a configuration similar to that of the first storage cassette 61. The reconciliation cassette 65 is also provided with the feed-in/feed-out mechanism 80, the stacking platform 81, and the passage sensor 82. That is, like the first storage cassette 61, the reconciliation cassette 65 is configured to receive and feed banknotes from and to the transport unit 40. The storage capacity of the reconciliation cassette 65 is preferably equal to or larger than that of the first to fourth storage cassette 61 to 64.

Collection Cassette

The collection cassette 70 is configured to store banknotes. In this example, the collection cassette 70 is of a stack type in which a plurality of banknotes are stacked and stored in the horizontal direction. The collection cassette 70 is of a cassette type that is in the shape of a rectangular parallelepiped elongated in the depth direction of the money processing device 10 and is detachable from the second safe unit 14 of the money processing device 10.

Specifically, the collection cassette 70 has a communication port in its upper surface through which banknotes are passed, and the second connection path 47 of the transport unit 40 is connected to the communication port. A banknote holder (not shown) is provided in the collection cassette 70. The banknote holder is configured to move in the depth direction of the money processing device 10 according to the amount of banknotes stacked and stored in the collection cassette 70. That is, the banknote holder moves toward the rear of the money processing device 10 (to the left in FIG. 2) as the amount of banknotes stored in the collection cassette 70 increases. With this configuration, banknotes fed from the transport unit 40 into the collection cassette 70 are stored side by side in a standing state in the depth direction.

The collection cassette 70 is provided with the passage sensor 82. Unlike the first to fourth storage cassettes 61 to 64 and the reconciliation cassette 65, the collection cassette 70 cannot feed banknotes stored therein.

Control Unit

Figure 3:
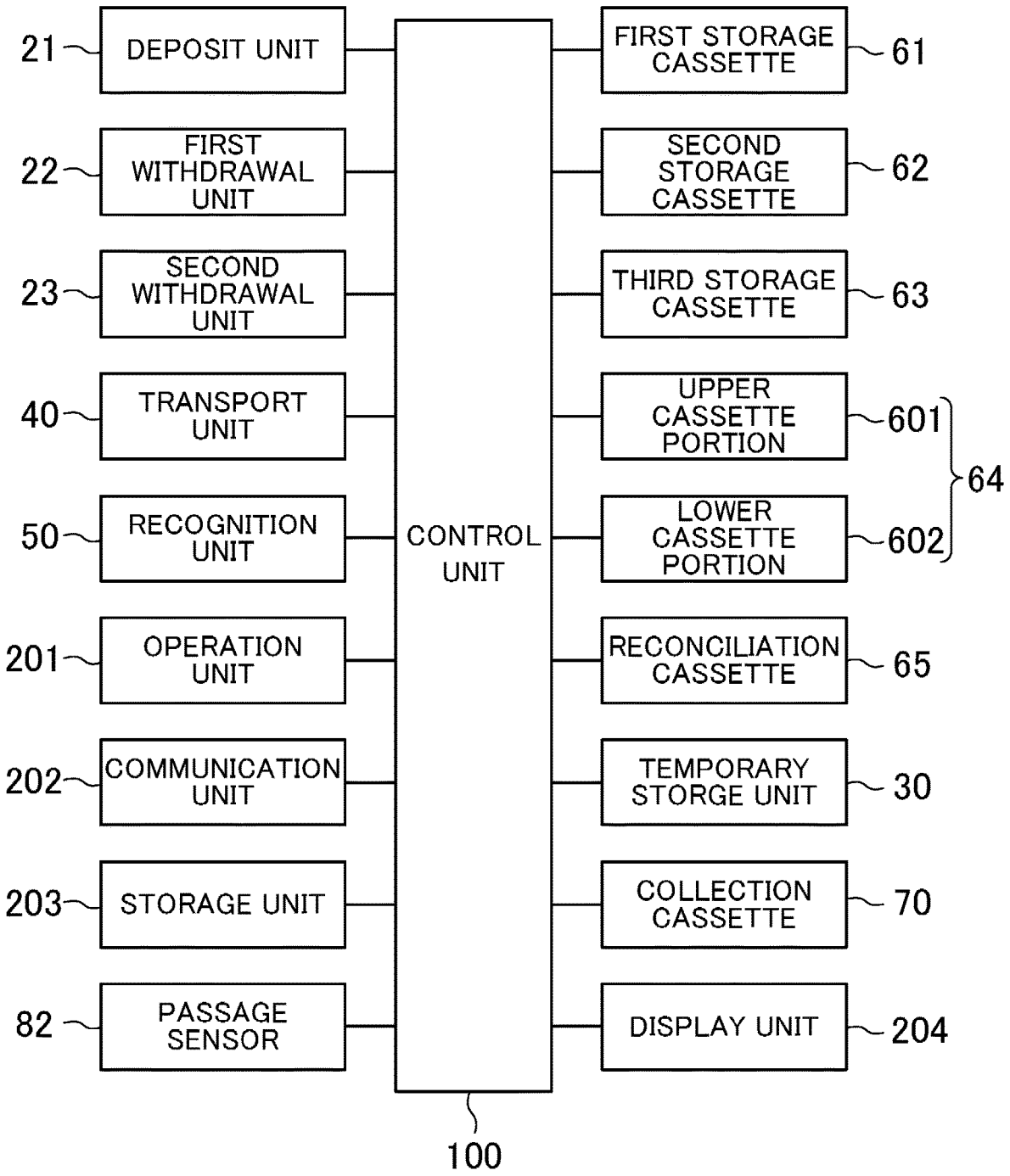
FIG. 3 is a block diagram illustrating a control unit.

The money processing device 10 includes a control unit 100. In this example, the control unit 100 is accommodated in the processing unit housing 11*a*. As shown in FIG. 3, the control unit 100 is connected to each part of the money processing device 10 so that it can communicate with each part of the money processing device 10. In this example, the control unit 100 is connected to the deposit unit 21, the first withdrawal unit 22, the second withdrawal unit 23, the temporary storage unit 30, the transport unit 40, the recognition unit 50, the first to third storage cassettes 61 to 63, the upper cassette portion 601 and the lower cassette portion 602 of the fourth storage cassette 64, the reconciliation cassette 65, and the collection cassette 70 so that the control unit 100 can communicate with these parts. For example, the control unit 100 is formed by an arithmetic processing unit such as a CPU, a storage unit such as a memory storing a program and information for operating the arithmetic processing unit, etc.

The control unit 100 is connected to external devices so that it can communicate with the external devices. In this example, the control unit 100 is connected to an operation unit 201, a communication unit 202, a storage unit 203, and a display unit 204 so that it can communicate with these units. The operation unit 201 is a human interface part for an operator who operates the money processing device 10 and is configured to input information according to an operation by the operator. The communication unit 202 is provided for the money processing device 10 to perform wired or wireless communication with a host machine or other external devices (not shown). For example, wired communication is communication using a LAN, a serial bus, etc. That is, the control unit 100 can communicate with the host machine and other external devices (not shown) via the communication unit 202. The storage unit 203 is provided to store various kinds of information and is, e.g., a versatile storage device such as a hard disk drive or a flash memory. The display unit 204 is provided to display various kinds of information and is, e.g., a flat panel display. Each part of the money processing device 10 is provided with various sensors (not shown) such as the passage sensor 82, and detection signals of the various sensors are sent to the control unit 100.

The control unit 100 controls each part of the money processing device 10 based on signals and information sent from each part of the money processing device 10 and the external devices to perform various processes in the money processing device 10. The various processes include at least one of a reconciliation process, a withdrawal process, a collection process, and a loading process. The various processes of the money processing device 10 will be described later in detail.

Set Denominations

In the money processing device 10, the denomination of banknotes that are supposed to be stored is assigned to the storage unit that stores and feeds banknotes. Specifically, the denominations of banknotes that are supposed to be stored are assigned to the first to third storage cassettes 61 to 63 and the upper cassette portion 601 and the lower cassette portion 602 of the fourth storage cassette 64 which are examples of the storage unit. In the following description, the denomination of banknotes assigned to the storage unit as the denomination of banknotes that are supposed to be stored in this storage unit is referred to as the "set denomination."

The set denominations assigned to the storage unit are stored in the storage unit 203. That is, the storage unit 203 stores set denomination information indicating correspondence between the storage unit and the set denomination. The set denomination information is information indicating which denomination is assigned to which storage unit as the set denomination. The control unit 100 can obtain the set denomination assigned to the storage unit based on the set denomination information stored in the storage unit 203.

Wrong Denomination Money and Storage Abnormality

In the case where the denomination of a part or all of the banknotes stored in the storage unit does not match the denomination of banknotes that are supposed to be stored in the storage unit, the denomination of a part or all of the banknotes fed from the storage unit and recognized by the recognition unit 50 does not match the set denomination assigned to the storage unit. Such an abnormality occurs when a banknote(s) of a denomination(s) different from the set denomination assigned to the storage unit is erroneously stored in the storage unit. For example, such an abnormality occurs due to wrong attachment of the storage unit such as in the case where the second storage cassette 62 is erroneously attached to the position to which the first storage cassette 61 is supposed to be attached. Such an abnormality also occurs in the case where the denomination different from that of banknotes that are supposed to be stored in the storage unit is erroneously assigned to the storage unit as the set denomination. For example, such an abnormality occurs due to wrong setting of the set denomination such as in the case where the denomination to be assigned to the second storage cassette 62 as the set denomination is erroneously assigned to the first storage cassette 61 as the set denomination.

In the following description, of the banknotes fed from the storage unit that is a transport origin and recognized by the recognition unit 50, any banknote whose denomination recognized by the recognition unit 50 does not match the set denomination assigned to the storage unit that is the transport origin is referred to as "wrong denomination money."

In the following description, an abnormality in which the denomination of a part or all of the banknotes stored in the storage unit that stores and feeds banknotes does not match the denomination of banknotes that are supposed to be stored in the storage unit is referred to as a "storage abnormality."

Basic Operation of Control Unit

In the various processes of the money processing device 10, the control unit 100 controls the transport unit 40 so that each banknote fed from the storage unit that is the transport origin is recognized by the recognition unit 50 and transported to a predetermined transport destination according to the recognition result of the recognition unit 50.

Based on the recognition result of the banknote by the recognition unit 50, the control unit 100 determines whether the banknote is wrong denomination money or not. Specifically, the recognition unit 50 recognizes the denomination of a banknote fed from the storage unit that is the transport origin. Based on the recognition result of the denomination of the banknote by the recognition unit 50, the control unit 100 determines whether this banknote is wrong denomination money or not. For example, the control unit 100 compares the denomination of the banknote recognized by the recognition unit 50 with the set denomination assigned to the storage unit that is the transport origin of this banknote. When the denomination of the banknote does not match the set denomination, the control unit 100 determines that this banknote is wrong denomination money. The set denomination is stored in the storage unit 203. In the money processing device 10, a wrong denomination storage unit for storing the wrong denomination money is determined in advance for each of the various processes. The control unit 100 controls the transport unit 40 so that the wrong denomination money is transported to the wrong denomination storage unit determined in advance for each of the various processes. For example, the temporary storage unit 30 is used as the wrong denomination storage unit.

In the various processes of the money processing device 10, the control unit 100 outputs information on a storage abnormality of the storage unit that is the transport origin, based on information on the wrong denomination money. In the following description, the information on the wrong denomination money is referred to as "wrong denomination money information," and the information on the storage abnormality of the storage unit that is the transport origin is referred to as "storage abnormality information." For example, the control unit 100 outputs the storage abnormality information to the display unit 204 to display an image indicating the storage abnormality information on the display unit 204. The storage abnormality information will be described later in detail.

Wrong Denomination Money Information

In this example, the wrong denomination money information includes information on the number of pieces of wrong denomination money. Specifically, the wrong denomination money information includes information on the total number of pieces of wrong denomination money for a predetermined period. The wrong denomination money information also includes information on the number of consecutive pieces of wrong denomination money, namely the number of consecutive banknotes determined to be wrong denomination money. For example, the control unit 100 counts the number of pieces of wrong denomination money based on the recognition result of banknotes by the recognition unit 50 and outputs wrong denomination money information including information on the number of pieces of wrong denomination money based on the counting result.

The control unit 100 is configured to obtain the information on the number of pieces of wrong denomination money from the wrong denomination money information and, when the number of pieces of wrong denomination money is larger than a predetermined threshold, output storage abnormality information. This threshold is a reference value for determining whether or not a storage abnormality has occurred in the storage unit in the various processes of the money processing device 10. For example, this threshold is set to such a number of pieces of wrong denomination money that a storage abnormality can be regarded as having occurred in the storage unit that is the transport origin. In the present embodiment, the predetermined threshold of the number of pieces of wrong denomination money is referred to as the "storage abnormality threshold." The storage abnormality threshold will be described later in detail.

Effects of Embodiment

As described above, in the various processes of the money processing device 10, the storage abnormality information is output based on the wrong denomination money information. In the various processes of the money processing device 10, a storage abnormality of the storage unit that is the transport origin (a storage abnormality in which the denomination of a part or all of the banknotes stored in the storage unit do not match the denomination of banknotes that are supposed to be stored in the storage unit) can thus be verified.

Since the storage abnormality of the storage unit that is the transport origin can be verified, the operator of the money processing device 10 can fix wrong attachment of the storage unit that is the transport origin or wrong setting of the denomination.

In the money processing device 10 according to the present embodiment, the wrong denomination money information includes the information on the number of pieces of wrong denomination money. Accordingly, the control unit 100 can output the storage abnormality information based on the number of pieces of wrong denomination money.

In the money processing device 10 according to the present embodiment, the control unit 100 is configured to output the storage abnormality information when the number of pieces of wrong denomination money is larger than the predetermined storage abnormality threshold. In the case where a storage abnormality has occurred in the storage unit that is the transport origin, there are a large number of pieces of wrong denomination money. Since the storage abnormality information is output when the number of pieces of wrong denomination money is larger than the predetermined storage abnormality threshold, the storage abnormality information can be appropriately output according to the number of pieces of wrong denomination money.

Details of Storage Abnormality Threshold

The storage abnormality threshold, which is a predetermined threshold of the number of pieces of wrong denomination money, may be set to the following value.

For example, in the case where the wrong denomination money information includes information on the cumulative number of pieces of wrong denomination money, the storage abnormality information may be set to a value according to the storage capacity of the transport destination of the wrong denomination money. Specifically, the storage abnormality threshold may be set to such a number of pieces of wrong denomination money that a storage abnormality occurs in the storage unit that is the transport origin and the transport destination of the wrong denomination money may be filled with the wrong denomination money. For example, the storage abnormality threshold may be set to 90% of the storage capacity of the transport destination of the wrong denomination money.

As described above, by setting the storage abnormality threshold to a value according to the storage capacity of the transport destination of the wrong denomination money, the control unit 100 can output the storage abnormality information when the number of pieces of wrong denomination money is larger than the value according to the storage capacity of the transport destination of the wrong denomination money. If the wrong denomination money continues to be transported to the transport destination even though a storage abnormality has occurred in the storage unit that is the transport origin, an error stop may occur due to the presence of a large number of pieces of wrong denomination money. Accordingly, such an error stop due to the presence of a large number of pieces of wrong denomination money can be prevented by comparing the number of pieces of wrong denomination money with the value according to the storage capacity of the transport destination of the wrong denomination money and outputting the storage abnormality information.

In the case where the wrong denomination information includes the information on the cumulative number of pieces of wrong denomination money, the storage abnormality threshold may be set to a value according to the total number of banknotes fed from the storage unit that is the transport origin. Specifically, the storage abnormality threshold may be set to the total number of banknotes fed from the storage unit that is the transport origin multiplied by a predetermined ratio. As used herein, the ratio is the ratio of the number of pieces of wrong denomination money to the total number of banknotes fed from the storage unit and is such a ratio that a storage abnormality can be regarded as having occurred in the storage unit that is the transport origin. For example, the ratio is 90%.

As described above, by setting the storage abnormality threshold to a value according to the total number of banknotes stored in the storage unit, the control unit 100 can output the storage abnormality information when the number of pieces of wrong denomination money is larger than the value according to the total number of banknotes fed from the storage unit. In the case where a storage abnormality has occurred in the storage unit that is the transport origin, the ratio of the number of pieces of wrong denomination money to the total number of banknotes fed from this storage unit tends to be relatively high. Accordingly, by comparing the number of pieces of wrong denomination money with the value according to the total number of banknotes fed from the storage unit and outputting the storage abnormality information, the storage abnormality information can be appropriately output according to the number of pieces of wrong denomination money.

In the case where the wrong denomination money information includes the information on the number of consecutive pieces of wrong denomination money, the storage abnormality threshold may be set to the number of pieces of wrong denomination money which are consecutively transported to the transport destination of the wrong denomination money when a storage abnormality can be regarded as having occurred in the storage unit that is the transport origin. For example, the storage abnormality threshold is 15.

Details of Storage Abnormality Information

The storage abnormality information may include the following information.

For example, the storage abnormality information may include abnormality notification information that is information that notifies that a storage abnormality has occurred in the storage unit that is the transport origin. For example, the control unit 100 may be configured to output the storage abnormality information including the abnormality notification information to the display unit 204 to display an image including the abnormality notification information on the display unit 204. For example, the image including the abnormality notification information is an image indicating that a storage abnormality has occurred in the storage unit that is the transport origin.

The storage abnormality information may include information on the set denomination. Specifically, the storage abnormality information may include information on the set denomination assigned to the storage unit that is the transport origin. For example, the control unit 100 may be configured to output the storage abnormality information including both the information on the set denomination and the abnormality notification information to the display unit 204 to display an image including the abnormality notification information and an image indicating the information on the set denomination on the display unit 204. The image indicating the information on the set denomination may be displayed after the image including the abnormality notification information is displayed. For example, the image indicating the information on the set denomination is an image indicating the set denomination assigned to the storage unit that is the transport origin.

As described above, since the storage abnormality information includes the information on the set denomination, the storage abnormality of the storage unit that is the transport origin and the set denomination of this storage unit can be verified.

The storage abnormality information may include information on the denomination of the wrong denomination money. For example, the control unit 100 may be configured to output the storage abnormality information including both the information on the denomination of the wrong denomination money and the abnormality notification information to the display unit 204 to display an image including the abnormality notification information and the information on the denomination of the wrong denomination money on the display unit 204. The information on the denomination of the wrong denomination money may be displayed after the image including the abnormality notification information is displayed. For example, the information on the denomination of the wrong denomination money is an image indicating the denomination of the wrong denomination money.

As described above, since the storage abnormality information includes the information on the denomination of the wrong denomination money, the storage abnormality of the storage unit that is the transport origin and the denomination of the wrong denomination money can be verified.

(Abnormality Handling Operation)

In the various processes of the money processing device 10, the control unit 100 may be configured to perform the following operation after stopping the various processes of the money processing device 10 in the case where a storage abnormality has occurred in the storage unit that is the transport origin and the control unit 100 outputs the storage abnormality information.

<Money Returning Operation>

For example, the control unit 100 may be configured to perform a money returning operation when it outputs the storage abnormality information in the various processes of the money processing device 10. In the money returning operation, the control unit 100 controls the transport unit 40 so that the banknotes that are the wrong denomination money fed from the wrong denomination storage unit return to the storage unit that is the transport origin. For example, the temporary storage unit 30 is used as the wrong denomination storage unit, and the first storage cassette 61 is used as the storage unit.

By performing the money returning operation as described above, the wrong denomination money stored in the wrong denomination storage unit can be returned to the storage unit that is the transport origin in the case where the storage abnormality information is output in the various processes of the money processing device 10.

<Money Dispensing Operation>

In the various processes of the money processing device 10, a dispense unit for dispensing the wrong denomination money may be determined in advance. The control unit 100 may be configured to perform a money dispensing operation when it outputs the storage abnormality information in the various processes of the money processing device 10. In the money dispensing operation, the control unit 100 controls the transport unit 40 so that the banknotes that are the wrong denomination money fed from the wrong denomination storage unit are transported to the dispense unit. For example, the second withdrawal unit 23 is used as the dispense unit.

By performing the money dispensing operation as described above, the wrong denomination money stored in the wrong denomination storage unit can be dispensed from the dispense unit to the outside of the money processing device 10 in the case where the storage abnormality information is output in the various processes of the money processing device 10.

<Setting Change Operation>

The control unit 100 may be configured to perform a setting change operation when it outputs the storage abnormality information in the various processes of the money processing device 10. In the setting change operation, the control unit 100 changes the set denomination assigned to the storage unit that is the transport origin to the denomination of the wrong denomination money. In the case where the wrong denomination money includes a plurality of denominations, the set denomination assigned to the storage unit that is the transport origin is changed to the most numerous denomination.

By performing the setting change operation as described above, the denomination of the banknotes stored in the storage unit that is the transport origin can be made to match the set denomination, namely the denomination of banknotes that are supposed to be stored in the storage unit that is the transport origin, in the case where the storage abnormality information is output in the various processes of the money processing device 10. This eliminates the storage abnormality of the storage unit that is the transport origin.

Various Processes of Money Processing Device

Next, the reconciliation process, the withdrawal process, the collection process, and the loading process of the money processing device 10 will be described with reference to FIGS. 4 to 8. In the following description, of the banknotes fed from the storage unit that is the transport origin and recognized by the recognition unit 50, any banknote whose denomination recognized by the recognition unit 50 matches the set denomination assigned to the storage unit that is the transport origin and which is permitted to be transported to a predetermined transport destination in the various processes of the money processing device 10 is referred to as "normal money."

Reconciliation Process

First, the reconciliation process of the money processing device 10 will be described with reference to FIGS. 4 and 5. The reconciliation process is a process of counting the banknotes stored in the storage unit and checking the number of banknotes against the number of banknotes that are supposed to have been stored in the storage unit. The number of banknotes that are supposed to have been stored in the storage unit may be a value for each denomination of the banknotes. The reconciliation process may be a process of counting the banknotes stored in the storage unit and determining the number and type of the banknotes etc.

In the reconciliation process, a storage unit that is the transport origin and a wrong denomination storage unit for storing the wrong denomination money are determined in advance. The storage unit that is the transport origin is a storage unit to be subjected to the reconciliation process. In the example of FIGS. 4 and 5, the first storage cassette 61 is the storage unit that is the transport origin, and the temporary storage unit 30 is the wrong denomination storage unit.

<Basic Operation in Reconciliation Process>

In the reconciliation process, the control unit 100 controls the transport unit 40 so that the banknotes fed from the storage unit that is the transport origin are recognized by the recognition unit 50 and return to the storage unit that is the transport origin according to the recognition result of the recognition unit 50. In the reconciliation process, the control unit 100 also controls the transport unit 40 so that the wrong denomination money is transported to the wrong denomination storage unit.

Specifically, in the reconciliation process, a reconciliation storage unit for temporarily storing the banknotes in the reconciliation process is determined in advance in addition to the wrong denomination storage unit. In this example, the reconciliation cassette 65 is the reconciliation storage unit. In this example, the reconciliation process include a first reconciliation process and a second reconciliation process.

<First Reconciliation Process>

First, the first reconciliation process will be described. In the first reconciliation process, the control unit 100 controls the transport unit 40 so that the transport unit 40 performs primary transport and secondary transport. In the primary transport, the banknotes fed from the storage unit that is the transport origin are recognized by the recognition unit 50 and transported to the reconciliation storage unit. In the secondary transport, the banknotes fed from the reconciliation storage unit are transported to either the storage unit that is the transport origin or the wrong denomination storage unit according to the recognition result of the banknotes by the recognition unit 50 which is obtained in the primary transport. The following operation is performed in the first reconciliation process.

Figure 4:
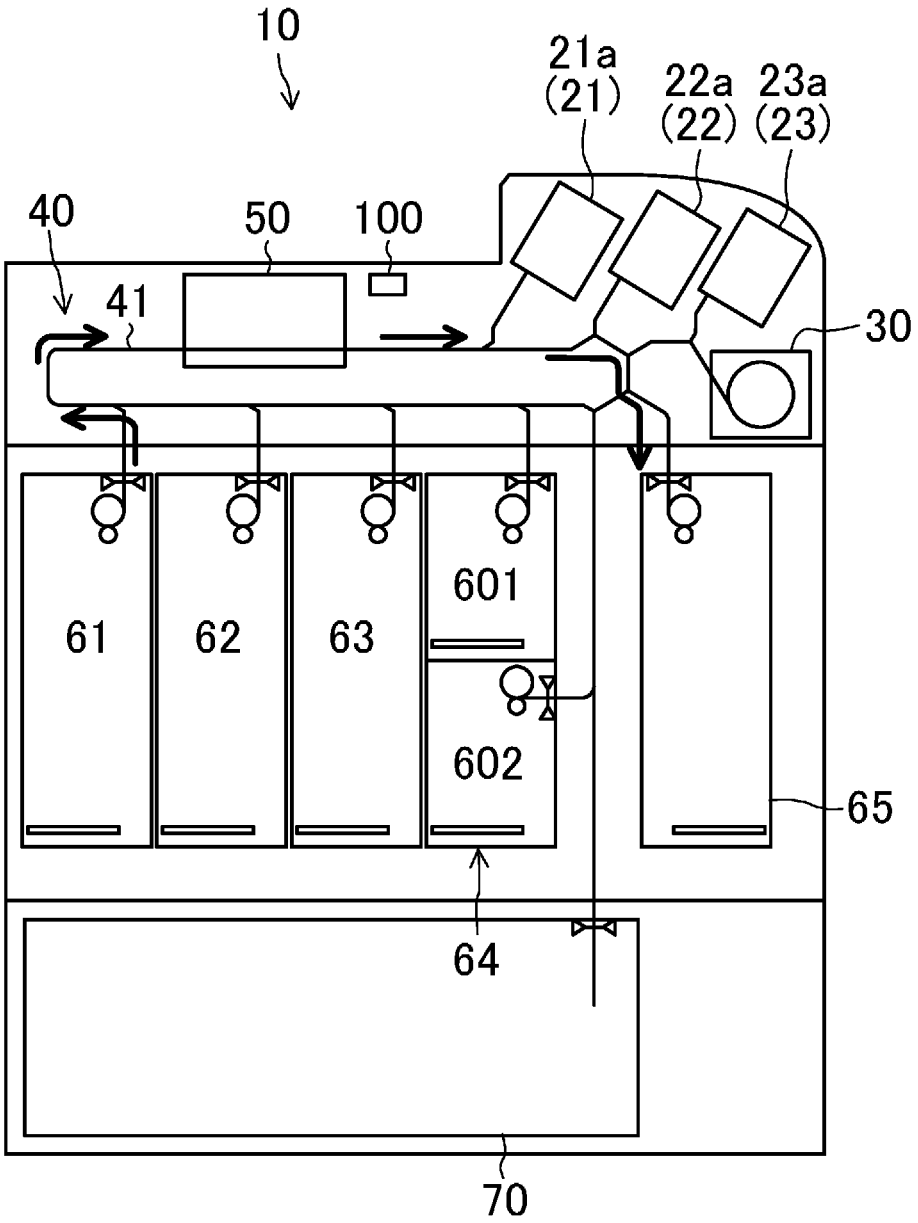
FIG. 4 is a sectional view illustrating a reconciliation process (primary transport).

First, as shown in FIG. 4, in the primary transport of the first reconciliation process, a banknote fed from the first storage cassette 61 is transported by the transport unit 40 to the recognition unit 50 and is recognized by the recognition unit 50. The recognized banknote is then transported to the reconciliation cassette 65. Information obtained in the recognition unit 50, namely the recognition result of the banknote by the recognition unit 50, is sent to the control unit 100. The information obtained in the recognition unit 50 includes information on the denomination of the banknote recognized by the recognition unit 50. All the banknotes stored in the first storage cassette 61 thus sequentially pass through the recognition unit 50 and are transported to the reconciliation cassette 65 one by one.

In the primary transport of the first reconciliation process, the control unit 100 determines whether each banknote fed from the first storage cassette 61 and recognized by the recognition unit 50 is normal money or wrong denomination money based on the information obtained in the recognition unit 50. In this example, the normal money refers to any banknote whose denomination recognized by the recognition unit 50 matches the set denomination assigned to the storage unit that is the transport origin and which is permitted to return to the storage unit that is the transport origin.

When the primary transport of the first reconciliation process is completed, the secondary transport of the first reconciliation process is performed. In the secondary transport of the first reconciliation process, the control unit 100 controls the transport unit 40 so that the normal money out of the banknotes stored in the reconciliation cassette 65 is transported to the first storage cassette 61 as shown by the solid arrows in FIG. 5. The control unit 100 also controls the transport unit 40 so that the wrong denomination money out of the banknotes stored in the reconciliation cassette 65 is transported to the temporary storage unit 30 as shown by the dashed arrow in FIG. 5.

In the primary transport of the first reconciliation process, the control unit 100 outputs the storage abnormality information based on the wrong denomination money information. For example, in the primary transport of the first reconciliation process, the control unit 100 outputs the storage abnormality information when the number of pieces of wrong denomination money is larger than the storage abnormality threshold.

By providing the wrong denomination storage unit in the reconciliation process (first reconciliation process) as described above, wrong denomination money out of the banknotes that are processed in the reconciliation process can be transported to the wrong denomination storage unit. By outputting the storage abnormality information in the reconciliation process, the storage abnormality of the storage unit that is the transport origin can be verified in the reconciliation process.

<Abnormality Handling Operation in First Reconciliation Process>

The control unit 100 may be configured to perform the following operation after stopping the first reconciliation process in the case where a storage abnormality has occurred in the storage unit that is the transport origin and the storage abnormality information is output in the first reconciliation process.

<<First Abnormality Handling Operation in First Reconciliation Process>>

For example, the control unit 100 may be configured to stop the operation for the first reconciliation process and perform a first abnormality handling operation when it outputs the storage abnormality information in the primary transport of the first reconciliation process. In the first abnormality handling operation in the first reconciliation process, the control unit 100 controls the transport unit 40 so that the banknotes fed form the reconciliation storage unit return to the storage unit that is the transport origin.

The control unit 100 may also be configured to output, after completion of the first abnormality handling operation in the first reconciliation process, information instructing the operator to detach the storage unit that is the transport origin from the money processing device 10. For example, the control unit 100 may be configured to display on the display unit 204 an image instructing the operator to detach the storage unit that is the transport origin from the money processing device 10.

By performing the first abnormality handling operation in the first reconciliation process as described above, the banknotes stored in the reconciliation storage unit can be returned to the storage unit. The stored state of the banknotes in the storage unit that is the transport origin can be thus restored to their initial state, namely the state before the start of the first reconciliation process.

<<Second Abnormality Handling Operation in First Reconciliation Process>>

In the first reconciliation process, a dispense unit for dispensing the wrong denomination money may be determined in advance. For example, in this example, the second withdrawal unit 23 is the dispense unit. The control unit 100 may be configured to stop the operation for the first reconciliation process and perform a second abnormality handling operation when it outputs the storage abnormality information in the primary transport of the first reconciliation process. In the second abnormality handling operation in the first reconciliation process, the control unit 100 controls the transport unit 40 so that the banknotes fed form the reconciliation storage unit are transported to the dispense unit. In this example, the dispense unit is the second withdrawal unit 23.

The control unit 100 may also be configured to output, after completion of the second abnormality handling operation in the first reconciliation process, information instructing the operator to detach the storage unit that is the transport origin from the money processing device 10.

By performing the second abnormality handling operation in the first reconciliation process as described above, the banknotes stored in the reconciliation storage unit can be dispensed from the dispense unit to the outside of the money processing device 10.

<<Third Abnormality Handing Operation in First Reconciliation Process (Setting Change Operation)>>

The control unit 100 may be configured to stop the operation for the first reconciliation process and perform a third abnormality handling operation after completion of the primary transport of the first reconciliation process when it outputs the storage abnormality information in the primary transport of the first reconciliation process. In the third abnormality handling operation in the first reconciliation process, the control unit 100 changes the set denomination assigned to the storage unit that is the transport origin to the denomination of the wrong denomination money. The third abnormality handling operation in the first reconciliation process is an example of the setting change operation.

The control unit 100 may also be configured to output, after completion of the third abnormality handling operation in the first reconciliation process, information notifying that the set denomination assigned to the storage unit that is the transport origin has been changed. For example, the control unit 100 may be configured to display on the display unit 204 an image indicating the changed set denomination assigned to the storage unit that is the transport origin.

The control unit 100 may also be configured to perform the following secondary transport of the first reconciliation process after completion of the third abnormality handling operation in the first reconciliation process. In the secondary transport of the first reconciliation process, the control unit 100 controls the transport unit 40 so that, of the banknotes stored in the reconciliation storage unit, those banknotes whose denomination recognized by the recognition unit 50 matches the changed set denomination assigned to the storage unit that is the transport origin are transported to the storage unit that is the transport origin. The control unit 100 also controls the transport unit 40 so that, of the banknotes stored in the reconciliation storage unit, those banknotes whose denomination recognized by the recognition unit 50 does not match the changed set denomination assigned to the storage unit that is the transport origin are transported to the wrong denomination storage unit.

By performing the third abnormality handling operation in the first reconciliation process as described above, the denomination of the banknotes stored in the storage unit that is the transport origin can be made to match the denomination of banknotes that are supposed to be stored in the storage unit that is the transport origin. This eliminates the storage abnormality of the storage unit that is the transport origin.

<Second Reconciliation Process>

Next, the second reconciliation process will be described. In the second reconciliation process, the control unit 100 controls the transport unit 40 so that the transport unit 40 performs primary transport and secondary transport. In the primary transport, the banknotes fed from the storage unit that is the transport origin are transported to the reconciliation storage unit. In the secondary transport, the banknotes fed from the reconciliation storage unit are recognized by the recognition unit 50 and transported to either the storage unit that is the transport origin or the wrong denomination storage unit according to the recognition result of the recognition unit 50. The following operation is performed in the second reconciliation process.

As shown in FIG. 4, in the primary transport of the second reconciliation process, the banknotes fed from the first storage cassette 61 are first transported to the reconciliation cassette 65 by the transport unit 40.

When the primary transport of the second reconciliation process is completed, the secondary transport of the second reconciliation process is then performed. In the secondary transport of the second reconciliation process, the banknotes fed from the reconciliation cassette 65 are transported to the recognition unit 50 by the transport unit 40 and recognized by the recognition unit 50. Information obtained in the recognition unit 50 is sent to the control unit 100. The information obtained in the recognition unit 50 includes information on the denomination of each banknote recognized by the recognition unit 50.

In the secondary transport of the second reconciliation process, the control unit 100 determines whether each banknote fed from the reconciliation cassette 65 and recognized by the recognition unit 50 is normal money or wrong denomination money based on the information obtained in the recognition unit 50. In this example, the normal money refers to any banknote whose denomination recognized by the recognition unit 50 matches the set denomination assigned to the storage unit that is the transport origin and which is permitted to return to the storage unit that is the transport origin.

Figure 5:
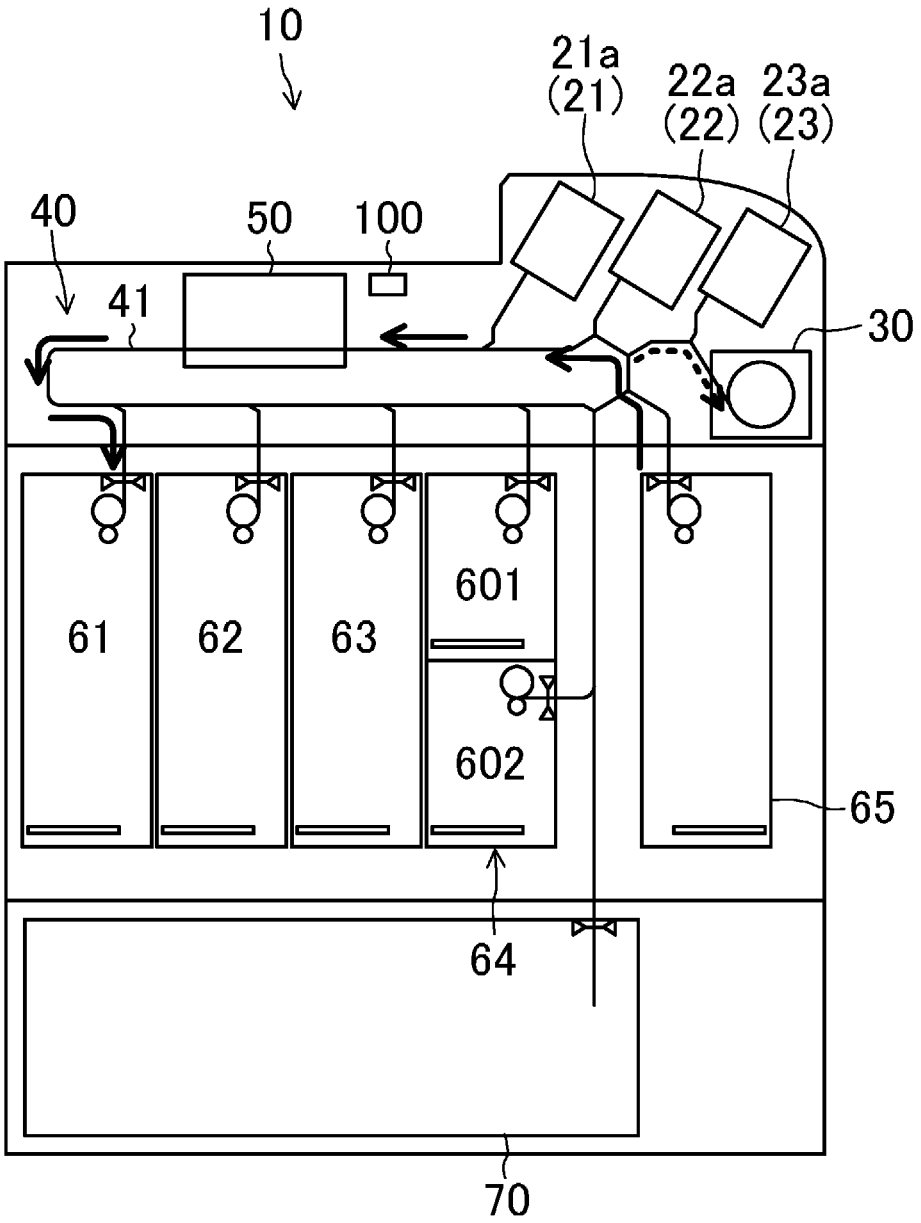
FIG. 5 is a sectional view illustrating a reconciliation process (secondary transport).

When the banknote recognized by the recognition unit 50 is normal money, the control unit 100 controls the transport unit 40 so that the banknote recognized by the recognition unit 50 is transported to the first storage cassette 61 as shown by the solid arrows in FIG. 5. When the banknote recognized by the recognition unit 50 is wrong denomination money, the control unit 100 controls the transport unit 40 so that the banknote recognized by the recognition unit 50 is transported to the temporary storage unit 30 as shown by the dashed arrow in FIG. 5.

In the secondary transport of the second reconciliation process, the control unit 100 outputs the storage abnormality information based on the wrong denomination money information. For example, in the secondary transport of the second reconciliation process, the control unit 100 outputs the storage abnormality information in the case where the number of pieces of wrong denomination money is larger than the storage abnormality threshold.

By providing the wrong denomination storage unit in the reconciliation process (second reconciliation process) as described above, wrong denomination money out of the banknotes that are processed in the reconciliation process can be transported to the wrong denomination storage unit. By outputting the storage abnormality information in the reconciliation process, the storage abnormality of the storage unit that is the transport origin can be verified in the reconciliation process.

<Abnormality Handling Operation in Second Reconciliation Process>

The control unit 100 may be configured to perform the following operation after stopping the second reconciliation process in the case where the control unit 100 outputs the storage abnormality information in the second reconciliation process.

<<First Abnormality Handling Operation in Second Reconciliation Process (Money Returning Operation)>>

For example, the control unit 100 may be configured to stop the operation for the second reconciliation process and perform a first abnormality handling operation when it outputs the storage abnormality information in the secondary transport of the second reconciliation process. In the first abnormality handling operation in the second reconciliation process, the control unit 100 controls the transport unit 40 so that the banknotes that are wrong denomination money fed from the wrong denomination storage unit and the banknotes fed form the reconciliation storage unit return to the storage unit that is the transport origin. The first abnormality handling operation in the second reconciliation process is an example of the money returning operation.

The control unit 100 may also be configured to output, after completion of the first abnormality handling operation in the second reconciliation process, information instructing the operator to detach the storage unit that is the transport origin from the money processing device 10.

By performing the first abnormality handling operation in the second reconciliation process as described above, the banknotes stored in the wrong denomination storage unit and the banknotes stored in the reconciliation storage unit can be returned to the storage unit. The stored state of the banknotes in the storage unit that is the transport origin can be thus restored to their initial state, namely the state before the start of the second reconciliation process.

<<Second Abnormality Handling Operation in Second Reconciliation Process (Money Returning Operation)>>

The control unit 100 may be configured to stop the operation for the second reconciliation process and perform a second abnormality handling operation when it outputs the storage abnormality information in the secondary transport of the second reconciliation process. In the second abnormality handling operation in the second reconciliation process, the control unit 100 controls the transport unit 40 so that the banknotes that are wrong denomination money fed form the wrong denomination storage unit return to the storage unit that is the transport origin. The second abnormality handling operation in the second reconciliation process is an example of the money returning operation.

The control unit 100 may also be configured to output, after completion of the second abnormality handling operation in the second reconciliation process, information instructing the operator to detach the storage unit that is the transport origin and the reconciliation storage unit from the money processing device 10. For example, the control unit 100 may be configured to display on the display unit 204 an image instructing the operator to detach the storage unit that is the transport origin and the reconciliation storage unit from the money processing device 10.

By performing the second abnormality handling operation in the second reconciliation process as described above, the wrong denomination money stored in the wrong denomination storage unit can be returned to the storage unit that is the transport origin.

For example, the second abnormality handling operation in the second reconciliation process is effective in the case where the wrong denomination storage unit is fixed to the money processing device 10 and therefore cannot be detached from the money processing device 10, in the case where the wrong denomination storage unit is of a take-up type and therefore the banknotes cannot be removed from the wrong denomination storage unit, etc.

<<Third Abnormality Handling Operation in Second Reconciliation Process (Money Dispensing Operation)>>

In the second reconciliation process, a dispense unit for dispensing the wrong denomination money may be determined in advance. In this example, the second withdrawal unit 23 is the dispense unit. The control unit 100 may be configured to stop the operation for the second reconciliation process and perform a third abnormality handling operation when it outputs the storage abnormality information in the secondary transport of the second reconciliation process. In the third abnormality handling operation in the second reconciliation process, the control unit 100 controls the transport unit 40 so that the banknotes that are wrong denomination money fed from the wrong denomination storage unit and the banknotes fed from the reconciliation storage unit are transported to the dispense unit. The third abnormality handling operation in the second reconciliation process is an example of the money dispensing operation.

The control unit 100 may also be configured to output, after completion of the third abnormality handling operation in the second reconciliation process, information instructing the operator to detach the storage unit that is the transport origin from the money processing device 10.

By performing the third abnormality handling operation in the second reconciliation process as described above, the money stored in the wrong denomination storage unit and the banknotes stored in the reconciliation storage unit can be dispensed from the dispense unit to the outside of the money processing device 10.

<<Fourth Abnormality Handling Operation in Second Reconciliation Process (Money Dispensing Operation)>>

In the case where a dispense unit for dispensing the wrong denomination money is determined in advance in the second reconciliation process, the control unit 100 may be configured to stop the operation for the second reconciliation process and perform a fourth abnormality handling operation when it outputs the storage abnormality information in the secondary transport of the second reconciliation process. In the fourth abnormality handling operation in the second reconciliation process, the control unit 100 controls the transport unit 40 so that the banknotes that are wrong denomination money fed from the wrong denomination storage unit are transported to the dispense unit. The fourth abnormality handling operation in the second reconciliation process is an example of the money dispensing operation.

The control unit 100 may also be configured to output, after completion of the fourth abnormality handling operation in the second reconciliation process, information instructing the operator to detach the storage unit that is the transport origin and the reconciliation storage unit from the money processing device 10.

By performing the fourth abnormality handling operation in the second reconciliation process as described above, the money stored in the wrong denomination storage unit can be dispensed from the dispense unit to the outside of the money processing device 10.

The fourth abnormality handling operation in the second reconciliation process is effective in the case where the wrong denomination storage unit cannot be detached from the money processing device 10, in the case where the banknotes cannot be removed from the wrong denomination storage unit, etc.

<<Fifth Abnormality Handling Operation in Second Reconciliation Process (Setting Change Operation)>>

The control unit 100 may be configured to stop the operation for the second reconciliation process and perform a fifth abnormality handling operation when it outputs the storage abnormality information in the secondary transport of the second reconciliation process. In the fifth abnormality handling operation in the second reconciliation process, the control unit 100 changes the set denomination assigned to the storage unit that is the transport origin to the denomination of the wrong denomination money. In the case where the wrong denomination money includes a plurality of denominations, the set denomination is changed to the most numerous denomination. The fifth abnormality handling operation in the second reconciliation process is an example of the setting change operation.

The control unit 100 may also be configured to output, after completion of the fifth abnormality handling operation in the second reconciliation process, information notifying that the set denomination assigned to the storage unit that is the transport origin has been changed.

The control unit 100 may also be configured to perform the secondary transport of the second reconciliation process again after completion of the fifth abnormality handling operation in the second reconciliation process. When performing the secondary transport of the second reconciliation process again, the control unit 100 controls the transport unit 40 to resume the secondary transport of the second reconciliation process after it controls the transport unit 40 so that the banknotes fed from the wrong denomination storage unit and the banknotes fed from the storage unit that is the transport origin return to the reconciliation storage unit. In the resumed secondary transport of the second reconciliation process, the wrong denomination money refers to any banknote whose denomination recognized by the recognition unit 50 does not match the changed set denomination assigned to the storage unit that is the transport origin. The normal money refers to any banknote whose denomination recognized by the recognition unit 50 matches the changed set denomination assigned to the storage unit that is the transport origin and which is permitted to return to the storage unit that is the transport origin.

By performing the fifth abnormality handling operation in the second reconciliation process as described above, the denomination of the banknotes stored in the storage unit that is the transport origin can be made to match the set denomination, namely the denomination of banknotes that are supposed to be stored in the storage unit that is the transport origin. This eliminates the storage abnormality of the storage unit that is the transport origin.

Withdrawal Process

Next, the withdrawal process of the money processing device 10 will be described with reference to FIG. 6. The withdrawal process is a process of withdrawing the banknotes stored in the storage unit.

In the withdrawal process, a storage unit that is the transport origin, a wrong denomination storage unit for storing wrong denomination money, and a withdrawal unit for dispensing banknotes to be withdrawn are determined in advance. The storage unit that is the transport origin is a storage unit to be subjected to the withdrawal process. In the example of FIG. 6, the first storage cassette 61 is the storage unit that is the transport origin, the temporary storage unit 30 is the wrong denomination storage unit, and the first withdrawal unit 22 is the withdrawal unit.

<Basic Operation in Withdrawal Process>

In the withdrawal process, the control unit 100 controls the transport unit 40 so that the banknotes fed from the storage unit that is the transport origin are recognized by the recognition unit 50 and transported to the withdrawal unit according to the recognition result of the recognition unit 50. In the withdrawal process, the control unit 100 also controls the transport unit 40 so that the wrong denomination money is transported to the wrong denomination storage unit. The following operation is performed in the withdrawal process.

Figure 6:
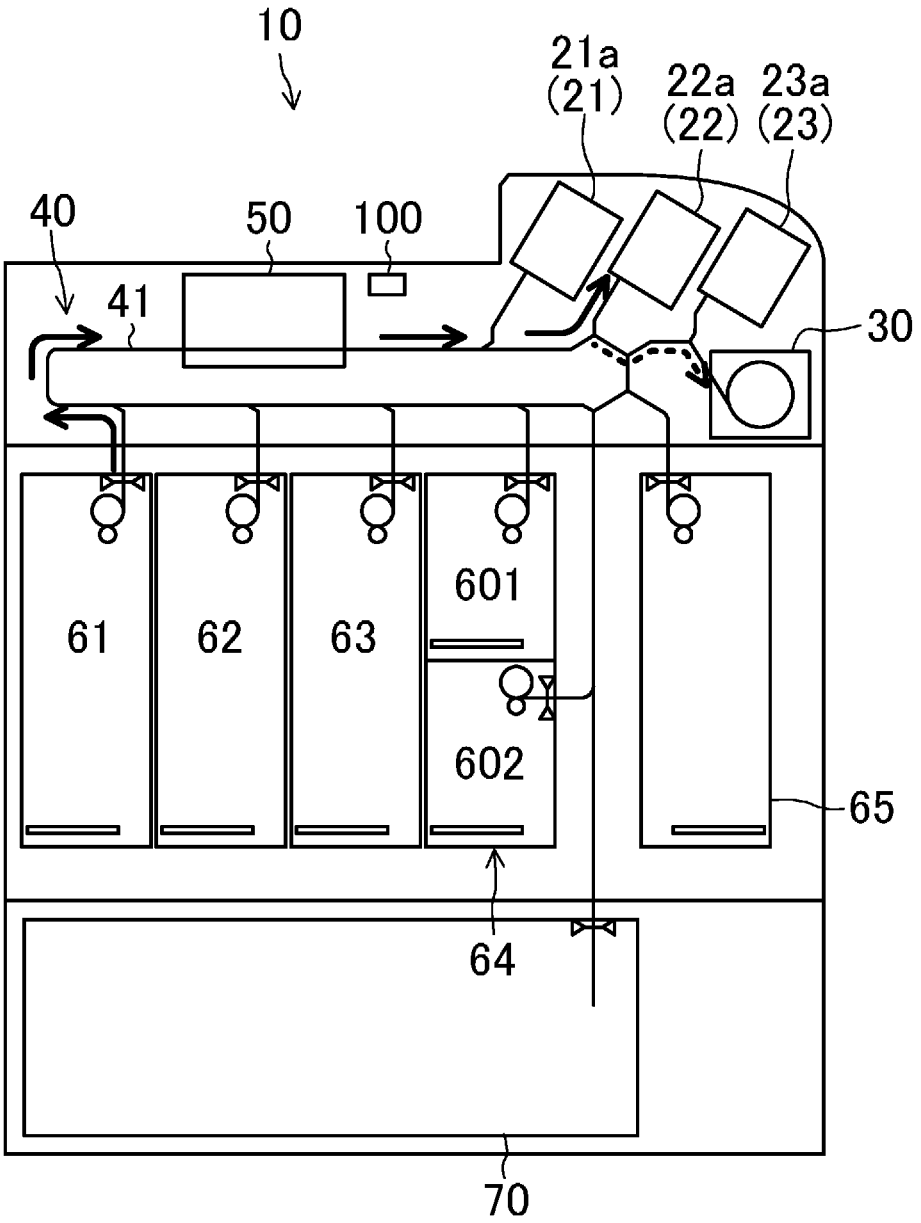
FIG. 6 is a sectional view illustrating a withdrawal process.

As shown in FIG. 6, in the withdrawal process, the banknotes fed from the first storage cassette 61 are transported by the transport unit 40 to the recognition unit 50 and recognized by the recognition unit 50. Information obtained in the recognition unit 50 is sent to the control unit 100. The information obtained in the recognition unit 50 includes information on the denomination of the banknotes obtained in the recognition unit 50.

The control unit 100 determines whether each banknote fed from the first storage cassette 61 and recognized by the recognition unit 50 is normal money or wrong denomination money based on the information obtained in the recognition unit 50. In this example, the normal money refers to any banknote whose denomination recognized by the recognition unit 50 matches the set denomination assigned to the storage unit that is the transport origin and which is permitted to be transported to the withdrawal unit.

When the banknote recognized by the recognition unit 50 is normal money, the control unit 100 controls the transport unit 40 so that the banknote recognized by the recognition unit 50 is transported to the first withdrawal unit 22 as shown by the solid arrows in FIG. 6. When the banknote recognized by the recognition unit 50 is wrong denomination money, the control unit 100 controls the transport unit 40 so that the banknote recognized by the recognition unit 50 is transported to the temporary storage unit 30 as shown by the dashed arrow in FIG. 6.

In the withdrawal process, the control unit 100 outputs the storage abnormality information based on the wrong denomination money information. For example, in the withdrawal process, the control unit 100 outputs the storage abnormality information when the number of pieces of wrong denomination money is larger than the storage abnormality threshold.

By providing the wrong denomination storage unit in the withdrawal process as described above, wrong denomination money out of the banknotes that are processed in the withdrawal process can be transported to the wrong denomination storage unit. By outputting the storage abnormality information in the withdrawal process, the storage abnormality of the storage unit that is the transport origin can be verified in the withdrawal process.

<Abnormality Handling Operation in Withdrawal Process>

The control unit 100 may be configured to perform the following operation after stopping the withdrawal process of the money processing device 10 in the case where the control unit 100 outputs the storage abnormality information in the withdrawal process.

<<First Abnormality Handling Operation in Withdrawal Process (Money Returning Operation)>>

For example, the control unit 100 may be configured to stop the operation for the withdrawal process and perform a first abnormality handling operation when it outputs the storage abnormality information in the withdrawal process. In the first abnormality handling operation in the withdrawal process, the control unit 100 controls the transport unit 40 so that the wrong denomination money fed form the wrong denomination storage unit returns to the storage unit that is the transport origin. The first abnormality handling operation in the withdrawal process is an example of the money returning operation.

The control unit 100 may also be configured to output, after completion of the first abnormality handling operation in the withdrawal process, information instructing the operator to detach the storage unit that is the transport origin from the money processing device 10.

By performing the first abnormality handling operation in the withdrawal process as described above, the banknotes stored in the wrong denomination storage unit can be returned to the storage unit that is the transport origin.

The first abnormality handling operation in the withdrawal process is effective in the case where the wrong denomination storage unit cannot be detached from the money processing device 10, in the case where the banknotes cannot be removed from the wrong denomination storage unit, etc.

The control unit 100 may also be configured to output information instructing the operator to place the banknotes that are normal money dispensed from the withdrawal unit in the withdrawal process into the deposit unit 21 before it outputs the information instructing the operator to detach the storage unit that is the transport origin from the money processing device 10. For example, the control unit 100 may be configured to display on the display unit 204 an image instructing the operator to place the banknotes dispensed from the withdrawal unit in the withdrawal process into the deposit unit 21. When the banknotes are placed into the deposit unit 21, the control unit 100 controls the transport unit 40 so that the banknotes placed into the deposit unit 21 are recognized by the recognition unit 50 and transported to the storage unit that is the transport origin according to the recognition result of the recognition unit 50.

The withdrawal unit may be provided with a mechanism for feeding the banknotes from the withdrawal unit to the transport unit 40. For example, the withdrawal unit may be provided with a retracting mechanism to take in any banknote left in the withdrawal unit without being removed. In this case, the control unit 100 may be configured to control the transport unit 40 so that the banknotes fed from the withdrawal unit are transported to the storage unit that is the transport origin before it outputs the information instructing the operator to detach the storage unit that is the transport origin from the money processing device 10.

<<Second Abnormality Handling Operation in Withdrawal Process (Money Dispensing Operation)>>

In the withdrawal process, a dispense unit for dispensing the wrong denomination money may be determined in advance. In this example, the second withdrawal unit 23 is the dispense unit. The control unit 100 may be configured to stop the operation for the withdrawal process and perform a second abnormality handling operation when it outputs the storage abnormality information in the withdrawal process. In the second abnormality handling operation in the withdrawal process, the control unit 100 controls the transport unit 40 so that the wrong denomination money fed from the wrong denomination storage unit is transported to the dispense unit. The second abnormality handling operation in the withdrawal process is an example of the money dispensing operation.

The control unit 100 may also be configured to output, after completion of the second abnormality handling operation in the withdrawal process, information instructing the operator to detach the storage unit that is the transport origin from the money processing device 10.

By performing the second abnormality handling operation in the withdrawal process as described above, the banknotes stored in the wrong denomination storage unit can be dispensed from the dispense unit to the outside of the money processing device 10.

The second abnormality handling operation in the withdrawal process is effective in the case where the wrong denomination storage unit cannot be detached from the money processing device 10, in the case where the banknotes cannot be removed from the wrong denomination storage unit, etc.

<<Third Abnormality Handling Operation in Withdrawal Process (Setting Change Operation)>>

The control unit 100 may be configured to stop the operation for the withdrawal process and perform a third abnormality handling operation when it outputs the storage abnormality information in the withdrawal process. In the third abnormality handling operation in the withdrawal process, the control unit 100 changes the set denomination assigned to the storage unit that is the transport origin to the denomination of the wrong denomination money. In the case where the wrong denomination money includes a plurality of denominations, the set denomination is changed to the most numerous denomination. The third abnormality handling operation in the withdrawal process is an example of the setting change operation.

The control unit 100 may also be configured to output, after completion of the third abnormality handling operation in the withdrawal process, information notifying that the set denomination assigned to the storage unit that is the transport origin has been changed.

The control unit 100 may also be configured to perform the withdrawal process again after completion of the third abnormality handling operation in the withdrawal process. When performing the withdrawal process again, the control unit 100 controls the transport unit 40 to resume the withdrawal process after it controls the transport unit 40 so that the banknotes fed from the wrong denomination storage unit return to the storage unit that is the transport origin. In the resumed withdrawal process, the wrong denomination money refers to any banknote whose denomination recognized by the recognition unit 50 does not match the changed set denomination assigned to the storage unit that is the transport origin. The normal money refers to any banknote whose denomination recognized by the recognition unit 50 matches the changed set denomination assigned to the storage unit that is the transport origin and which is permitted to be transported to the withdrawal unit.

By performing the third abnormality handling operation in the withdrawal process as described above, the denomination of the banknotes stored in the storage unit that is the transport origin can be made to match the set denomination, namely the denomination of banknotes that are supposed to be stored in the storage unit that is the transport origin. This eliminates the storage abnormality of the storage unit that is the transport origin.

Collection Process

Next, the collection process of the money processing device 10 will be described with reference to FIG. 7. The collection process is a process of collecting the banknotes stored in the storage unit.

In the collection process, a storage unit that is the transport origin, a wrong denomination storage unit for storing wrong denomination money, and a collection storage unit for storing banknotes to be collected are determined in advance. The storage unit that is the transport origin is a storage unit to be subjected to the collection process. In the example of FIG. 7, the first storage cassette 61 is the storage unit that is the transport origin, the temporary storage unit 30 is the wrong denomination storage unit, and the collection cassette 70 is the collection storage unit.

<Basic Operation in Collection Process>

In the collection process, the control unit 100 controls the transport unit 40 so that the banknotes fed from the storage unit that is the transport origin are recognized by the recognition unit 50 and transported to the collection storage unit according to the recognition result of the recognition unit 50. In the collection process, the control unit 100 also controls the transport unit 40 so that the wrong denomination money is transported to the wrong denomination storage unit. The following operation is performed in the collection process.

Figure 7:
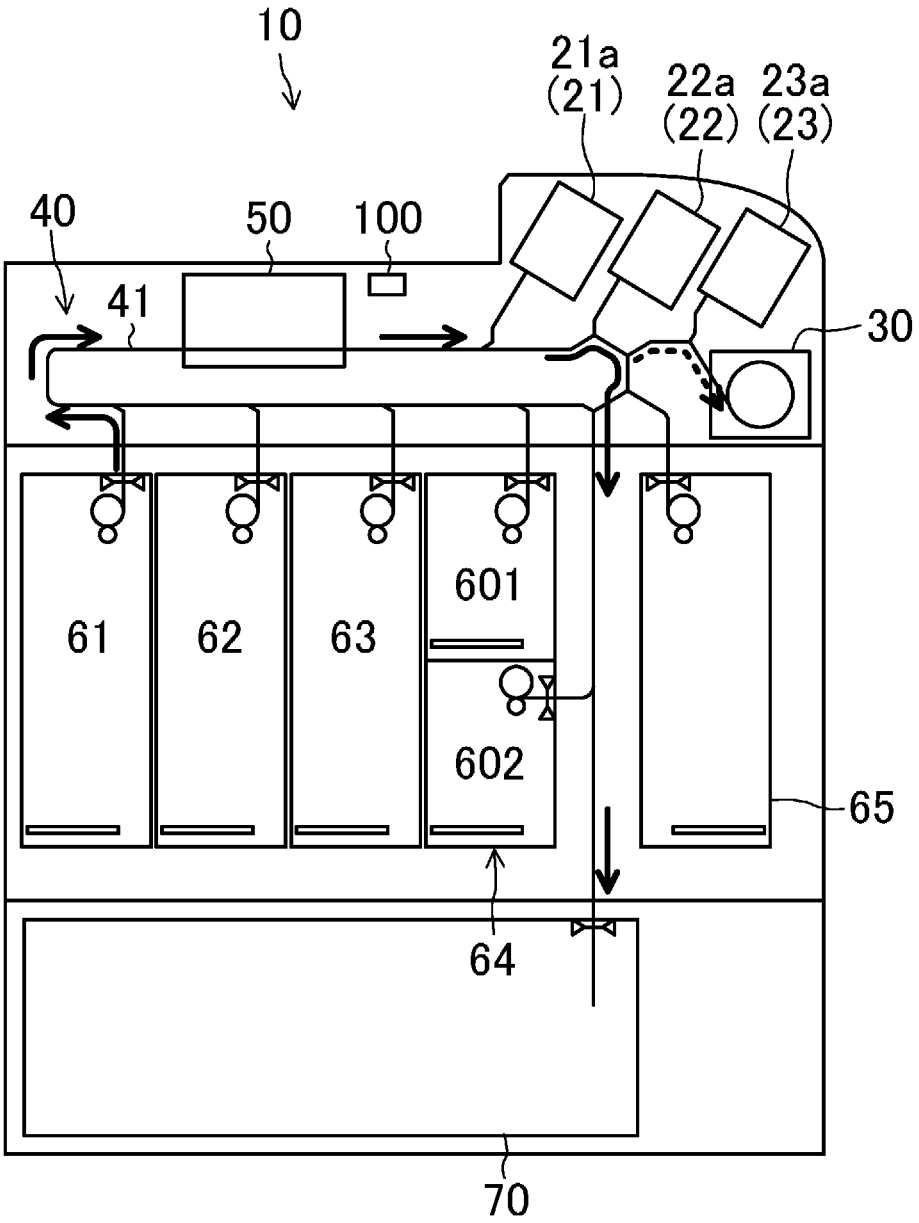
FIG. 7 is a sectional view illustrating a collection process.

As shown in FIG. 7, in the collection process, the banknotes fed from the first storage cassette 61 are transported to the recognition unit 50 by the transport unit 40 and recognized by the recognition unit 50. Information obtained in the recognition unit 50 is sent to the control unit 100. The information obtained in the recognition unit 50 includes information on the denomination of the banknotes obtained in the recognition unit 50.

The control unit 100 determines whether each banknote fed from the first storage cassette 61 and recognized by the recognition unit 50 is normal money or wrong denomination money based on the information obtained in the recognition unit 50. In this example, the normal money refers to any banknote whose denomination recognized by the recognition unit 50 matches the set denomination assigned to the storage unit that is the transport origin and which is permitted to be transported to the collection storage unit.

When the banknote recognized by the recognition unit 50 is normal money, the control unit 100 controls the transport unit 40 so that the banknote recognized by the recognition unit 50 is transported to the collection cassette 70 as shown by the solid arrows in FIG. 7. When the banknote recognized by the recognition unit 50 is wrong denomination money, the control unit 100 controls the transport unit 40 so that the banknote recognized by the recognition unit 50 is transported to the temporary storage unit 30 as shown by the dashed arrow in FIG. 7.

In the collection process, the control unit 100 outputs the storage abnormality information based on the wrong denomination money information. For example, in the collection process, the control unit 100 outputs the storage abnormality information in the case where the number of pieces of wrong denomination money is larger than the storage abnormality threshold.

By providing the wrong denomination storage unit in the collection process as described above, wrong denomination money out of the banknotes that are processed in the collection process can be transported to the wrong denomination storage unit. By outputting the storage abnormality information in the collection process, the storage abnormality of the storage unit that is the transport origin can be verified.

<Abnormality Handling Operation in Collection Process>

The control unit 100 may be configured to perform the following operation after stopping the collection process of the money processing device 10 in the case where the control unit 100 outputs the storage abnormality information in the collection process.

<<First Abnormality Handling Operation in Collection Process (Money Returning Operation)>>

For example, the control unit 100 may be configured to stop the operation for the collection process and perform a first abnormality handling operation when it outputs the storage abnormality information in the collection process. In the first abnormality handling operation in the collection process, the control unit 100 controls the transport unit 40 so that the wrong denomination money fed from the wrong denomination storage unit returns to the storage unit that is the transport origin. The first abnormality handling operation in the collection process is an example of the money returning operation.

The control unit 100 may also be configured to output, after completion of the first abnormality handling operation in the collection process, information instructing the operator to detach the storage unit that is the transport origin and the collection storage unit from the money processing device 10. For example, the control unit 100 may be configured to display on the display unit 204 an image instructing the operator to detach the storage unit that is the transport origin and the collection storage unit from the money processing device 10.

By performing the first abnormality handling operation in the collection process as described above, the banknotes stored in the wrong denomination storage unit can be returned to the storage unit that is the transport origin.

The first abnormality handling operation in the collection process is effective in the case where the wrong denomination storage unit cannot be detached from the money processing device 10, in the case where the banknotes cannot be removed from the wrong denomination storage unit, etc.

<<Second Abnormality Handling Operation in Collection Process (Money Dispensing Operation)>>

In the collection process, a dispense unit for dispensing the wrong denomination money may be determined in advance. In this example, the second withdrawal unit 23 is the dispense unit. The control unit 100 may be configured to stop the operation for the collection process and perform a second abnormality handling operation when it outputs the storage abnormality information in the collection process. In the second abnormality handling operation in the collection process, the control unit 100 controls the transport unit 40 so that the wrong denomination money fed from the wrong denomination storage unit is transported to the dispense unit. The second abnormality handling operation in the collection process is an example of the money dispensing operation.

The control unit 100 may also be configured to output, after completion of the second abnormality handling operation in the collection process, information instructing the operator to detach the storage unit that is the transport origin and the collection storage unit from the money processing device 10.

By performing the second abnormality handling operation in the collection process as described above, the banknotes stored in the wrong denomination storage unit can be dispensed from the dispense unit to the outside of the money processing device 10.

The second abnormality handling operation in the collection process is effective in the case where the wrong denomination storage unit cannot be detached from the money processing device 10, in the case where the banknotes cannot be removed from the wrong denomination storage unit, etc.

<<Third Abnormality Handling Operation in Collection Process (Setting Change Operation)>>

The control unit 100 may be configured to stop the operation for the collection process and perform a third abnormality handling operation when it outputs the storage abnormality information in the collection process. In the third abnormality handling operation in the collection process, the control unit 100 changes the set denomination assigned to the storage unit that is the transport origin to the denomination of the wrong denomination money. In the case where the wrong denomination money includes a plurality of denominations, the set denomination is changed to the most numerous denomination. The third abnormality handling operation in the collection process is an example of the setting change operation.

The control unit 100 may also be configured to output, after completion of the third abnormality handling operation in the collection process, information notifying that the set denomination assigned to the storage unit that is the transport origin has been changed.

The control unit 100 may also be configured to perform the collection process again after completion of the third abnormality handling operation in the collection process. When performing the collection process again, the control unit 100 controls the transport unit 40 to resume the collection process after it controls the transport unit 40 so that the banknotes fed from the wrong denomination storage unit return to the storage unit that is the transport origin. In the resumed collection process, the wrong denomination money refers to any banknote whose denomination recognized by the recognition unit 50 does not match the changed set denomination assigned to the storage unit that is the transport origin. The normal money refers to any banknote whose denomination recognized by the recognition unit 50 matches the changed set denomination assigned to the storage unit that is the transport origin and which is permitted to be transported to the collection storage unit.

By performing the third abnormality handling operation in the collection process as described above, the denomination of the banknotes stored in the storage unit that is the transport origin can be made to match the set denomination, namely the denomination of banknotes that are supposed to be stored in the storage unit that is the transport origin. This eliminates the storage abnormality of the storage unit that is the transport origin.

Loading Process

Next, the loading process of the money processing device 10 will be described with reference to FIG. 8. The loading process is a process of loading other storage unit with the banknotes stored in the storage unit.

In the loading process, a storage unit that is the transport origin, a wrong denomination storage unit for storing wrong denomination money, and a load storage unit to be loaded with banknotes are determined in advance. The storage unit that is the transport origin is a storage unit that stores banknotes for loading. In the example of FIG. 8, the reconciliation cassette 65 is the storage unit that is the transport origin, the temporary storage unit 30 is the wrong denomination storage unit, and the first storage cassette 61 is the load storage unit. The reconciliation cassette 65 stores banknotes of a single denomination, and the set denomination, namely the denomination of banknotes that are supposed to be stored in the reconciliation cassette 65, is assigned to the reconciliation cassette 65.

<Basic Operation in Loading Process>

In the loading process, the control unit 100 controls the transport unit 40 so that the banknotes fed from the storage unit that is the transport origin are recognized by the recognition unit 50 and transported to the load storage unit according to the recognition result of the recognition unit 50. In the loading process, the control unit 100 also controls the transport unit 40 so that the wrong denomination money is transported to the wrong denomination storage unit. The following operation is performed in the loading process.

Figure 8:
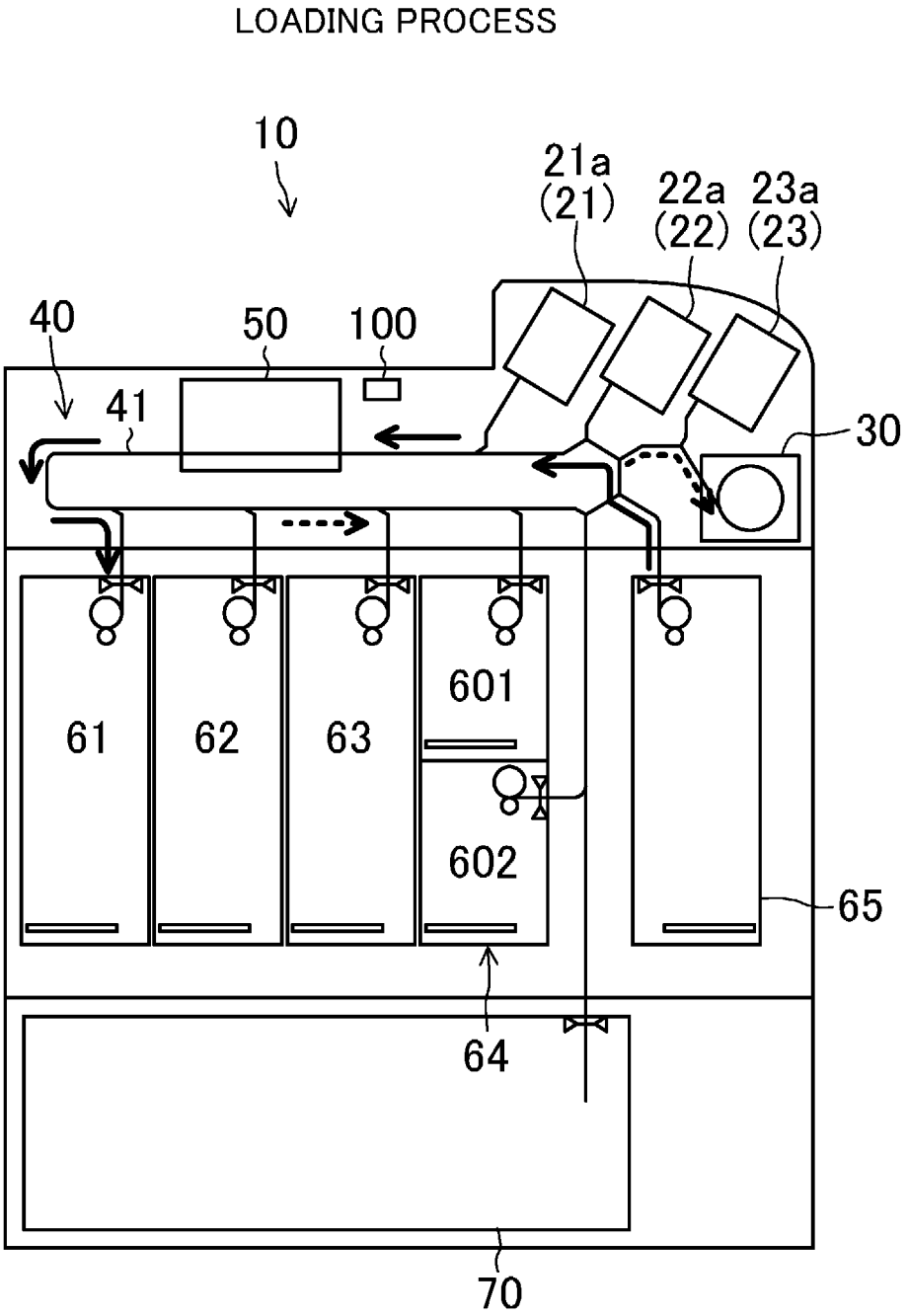
FIG. 8 is a sectional view illustrating a loading process.

As shown in FIG. 8, in the loading process, the banknotes fed from the reconciliation cassette 65 are transported to the recognition unit 50 by the transport unit 40 and recognized by the recognition unit 50. Information obtained in the recognition unit 50 is sent to the control unit 100. The information obtained in the recognition unit 50 includes information on the denomination of the banknotes obtained in the recognition unit 50.

The control unit 100 determines whether each banknote fed from the reconciliation cassette 65 and recognized by the recognition unit 50 is normal money or wrong denomination money based on the information obtained in the recognition unit 50. In this example, the normal money refers to any banknote whose denomination recognized by the recognition unit 50 matches the set denomination assigned to the storage unit that is the transport origin and which is permitted to be transported to the load storage unit.

When the banknote recognized by the recognition unit 50 is normal money, the control unit 100 controls the transport unit 40 so that the banknote recognized by the recognition unit 50 is transported to the first storage cassette 61 as shown by the solid arrows in FIG. 8. When the banknote recognized by the recognition unit 50 is wrong denomination money, the control unit 100 controls the transport unit 40 so that the banknote recognized by the recognition unit 50 is transported to the temporary storage unit 30 as shown by the dashed arrows in FIG. 8.

In the loading process, the control unit 100 outputs the storage abnormality information based on the wrong denomination money information. For example, in the loading process, the control unit 100 outputs the storage abnormality information in the case where the number of pieces of wrong denomination money is larger than the storage abnormality threshold.

By providing the wrong denomination storage unit in the loading process as described above, wrong denomination money out of the banknotes that are processed in the loading process can be transported to the wrong denomination storage unit. By outputting the storage abnormality information in the loading process, the storage abnormality of the storage unit that is the transport origin can be verified.

<Abnormality Handling Operation in Loading Process>

The control unit 100 may be configured to perform the following operation after stopping the loading process in the case where the control unit 100 outputs the storage abnormality information in the loading process.

<<First Abnormality Handling Operation in Loading Process (Money Returning Operation)>>

For example, the control unit 100 may be configured to stop the operation for the loading process and perform a first abnormality handling operation when it outputs the storage abnormality information in the loading process. In the first abnormality handling operation in the loading process, the control unit 100 controls the transport unit 40 so that the banknotes that are the wrong denomination money fed from the wrong denomination storage unit return to the storage unit that is the transport origin and, of the banknotes stored in the load storage unit, those banknotes newly stored in the loading process are fed from the load storage unit and return to the storage unit that is the transport origin. The first abnormality handling operation in the loading process is an example of the money returning operation.

The control unit 100 may also be configured to output, after completion of the first abnormality handling operation in the loading process, information instructing the operator to detach the storage unit that is the transport origin from the money processing device 10.

By performing the first abnormality handling operation in the loading process as described above, the banknotes stored in the wrong denomination storage unit and the banknotes newly stored in the load storage unit in the loading process can be returned to the storage unit that is the transport origin. The stored state of the banknotes in the storage unit that is the transport origin can be thus restored to their initial state, namely the state before the start of the loading process.

<<Second Abnormality Handling Operation in Loading Process (Money Returning Operation)>>

The control unit 100 may be configured to stop the operation for the loading process and perform a second abnormality handling operation when it outputs the storage abnormality information in the loading process. In the second abnormality handling operation in the loading process, the control unit 100 controls the transport unit 40 so that the banknotes that are the wrong denomination money fed from the wrong denomination storage unit return to the storage unit that is the transport origin. The second abnormality handling operation in the loading process is an example of the money returning operation.

In the case where no banknote is stored in the load storage unit before the start of the loading process, the control unit 100 may output, after completion of the second abnormality handling operation in the loading process, information instructing the operator to detach the storage unit that is the transport origin and the load storage unit from the money processing device 10. For example, the control unit 100 may be configured to display on the display unit 204 an image instructing the operator to detach the storage unit that is the transport origin and the load storage unit from the money processing device 10.

By performing the second abnormality handling operation in the loading process as described above, the banknotes stored in the wrong denomination storage unit can be returned to the storage unit that is the transport origin.

The second abnormality handling operation in the loading process is effective in the case where the wrong denomination storage unit cannot be detached from the money processing device 10, in the case where the banknotes cannot be removed from the wrong denomination storage unit, etc.

<<Third Abnormality Handling Operation in Loading Process (Money Dispensing Operation)>>

In the loading process, a dispense unit for dispensing the wrong denomination money may be determined in advance. In this example, the second withdrawal unit 23 is the dispense unit. The control unit 100 may be configured to stop the operation for the loading process and perform a third abnormality handling operation when it outputs the storage abnormality information in the loading process. In the third abnormality handling operation in the loading process, the control unit 100 controls the transport unit 40 so that the banknotes that are the wrong denomination money fed from the wrong denomination storage unit are transported to the dispense unit and, of the banknotes stored in the load storage unit, those banknotes newly stored in the loading process are fed from the load storage unit and transported to the dispense unit. The third abnormality handling operation in the loading process is an example of the money dispensing operation.

The control unit 100 may also be configured to output, after completion of the third abnormality handling operation in the loading process, information instructing the operator to detach the storage unit that is the transport origin from the money processing device 10.

By performing the third abnormality handling operation in the loading process as described above, the banknotes stored in the wrong denomination storage unit and the banknotes newly stored in the load storage unit in the loading process can be dispensed from the dispense unit to the outside of the money processing device 10.

<<Fourth Abnormality Handling Operation in Loading Process (Money Dispensing Operation)>>

In the case where a dispense unit for dispensing the wrong denomination money is determined in advance in the loading process, the control unit 100 may be configured to stop the operation for the loading process and perform a fourth abnormality handling operation when it outputs the storage abnormality information in the loading process. In the fourth abnormality handling operation in the loading process, the control unit 100 controls the transport unit 40 so that the banknotes that are the wrong denomination money fed from the wrong denomination storage unit are transported to the dispense unit. The fourth abnormality handling operation in the loading process is an example of the money dispensing operation.

In the case where no banknote is stored in the load storage unit before the start of the loading process, the control unit 100 may output, after completion of the fourth abnormality handling operation in the loading process, information instructing the operator to detach the storage unit that is the transport origin and the load storage unit from the money processing device 10.

By performing the fourth abnormality handling operation in the loading process as described above, the banknotes stored in the wrong denomination storage unit can be dispensed from the dispense unit to the outside of the money processing device 10.

The fourth abnormality handling operation in the loading process is effective in the case where the wrong denomination storage unit cannot be detached from the money processing device 10, in the case where the banknotes cannot be removed from the wrong denomination storage unit, etc.

Other Embodiments

In the first reconciliation process and/or the second reconciliation process of the money processing device 10, banknotes to be rejected may be stored in the wrong denomination storage unit in addition to wrong denomination money. Examples of the banknotes to be rejected include banknotes that cannot be recognized in the recognition unit 50 and counterfeit banknotes. That is, the control unit 100 may be configured to control the transport unit 40 so that the banknotes to be rejected are transported to the wrong denomination storage unit in the reconciliation process. In this case, the control unit 100 may control the transport unit 40 so that the banknotes fed from the wrong denomination storage unit return to the storage unit that is the transport origin in the money returning operation in the reconciliation process. Specifically, the control unit 100 may control the transport unit 40 so that both the wrong denomination money and the money to be rejected return to the storage unit that is the transport origin in the first and second abnormality handling operations in the second reconciliation process. The control unit 100 may control the transport unit 40 so that the banknotes fed from the wrong denomination storage unit are transported to the dispense unit in the money dispensing operation in the reconciliation process. Specifically, the control unit 100 may control the transport unit 40 so that both the wrong denomination money and the money to be rejected are transported to the dispense unit in the third and fourth abnormality handling operations in the second reconciliation process. The control unit 100 may control the transport unit 40 so that the money to be rejected out of the banknotes stored in the wrong denomination storage unit is fed from the wrong denomination storage unit and transported to a predetermined reject storage unit in the setting change operation in the reconciliation process. Specifically, the control unit 100 may control the transport unit 40 so that the money to be rejected which is fed from the wrong denomination storage unit is transported to the collection cassette 70 in the third abnormality handling operation in the first reconciliation process and the fifth abnormality handling operation in the second reconciliation process.

In the above description, the control unit 100 may be comprised of a single circuit chip such as an integrated circuit including a CPU and a memory or may be comprised of a plurality of circuit chips that communicate with each other. Components of the control unit 100 may be provided in the processing unit housing 11*a*, in the protective housing 12*a* that is located outside the processing unit housing 11*a*, or may be provided both in the processing unit housing 11*a* and in the outside of the protective housing 12*a*.

In the above description, the control unit 100 may be configured to determine whether or not it performs an abnormality handling operation in response to a command from the operator of the money processing device 10. The control unit 100 may be configured to select one of a plurality of abnormality handling operations in response to a command from the operator of the money processing device 10.

In the various processes of the money processing device 10, the storage abnormality information may be output either at the same timing as that the number of pieces of wrong denomination money becomes larger than the storage abnormality threshold or after the timing the number of pieces of wrong denomination money becomes larger than the storage abnormality threshold. The abnormal handling operation may be started either at the same timing as that the storage abnormality information is output or at a different timing from the timing the storage abnormality information is output.

The technique disclosed herein is applicable not only to banknote processing devices for processing banknotes (an example of the money processing device) but also to is applicable to coin processing devices for processing coins (an example of the money processing device).

The above embodiments may be combined as appropriate. The above embodiments are mere examples that are essentially preferable and are not intended to limit the invention, its applications, and its uses.

INDUSTRIAL APPLICABILITY

As described above, the technique disclosed herein is useful as money processing devices.

DESCRIPTION OF REFERENCE CHARACTERS

10 Money Processing Device
11 Processing Unit
12 Safe Unit
13 First Safe Unit
14 Second Safe Unit
21 Deposit Unit
22 First Withdrawal Unit
23 Second Withdrawal Unit
30 Temporary Storage Unit
40 Transport Unit
50 Recognition Unit
61 First Storage Cassette
62 Second Storage Cassette
63 Third Storage Cassette
64 Fourth Storage Cassette
65 Reconciliation Cassette
70 Collection Cassette

The invention claimed is:

1. A money processing device, comprising:
a storage that stores and feeds money;
a path that transports the money fed from the storage;
recognition circuitry configured to recognize a denomination of the money transported by the path; and
processing circuitry configured to output information on a storage abnormality of the storage based on information on wrong denomination money, the wrong denomination money being money whose denomination recognized by the recognition circuitry does not match a set denomination assigned to the storage as a denomination of money that is supposed to be stored in the storage, wherein
the information on the wrong denomination money includes information on a number of pieces of the wrong denomination money, and
the processing circuitry outputs the information on the storage abnormality of the storage when a cumulative number of pieces of the wrong denomination money or a number of consecutive pieces of the wrong denomination money is larger than a predetermined threshold.

2. The money processing device of claim 1, wherein
the threshold is set to a value according to a total number of pieces of the money fed from the storage.

3. The money processing device of claim 1, wherein
the information on the storage abnormality of the storage includes information on the set denomination.

4. The money processing device of claim 1, wherein
the information on the storage abnormality of the storage includes information on the denomination of the wrong denomination money.

5. The money processing device of claim 1, further comprising:
a wrong denomination storage that stores the wrong denomination money, wherein
in a reconciliation process in which the money fed from the storage is recognized by the recognition circuitry, the processing circuitry controls the path so that the wrong denomination money is transported to the wrong denomination storage.

6. The money processing device of claim 5, wherein
when the processing circuitry outputs the information on the storage abnormality of the storage, the processing circuitry controls the path so that the wrong denomination money fed from the wrong denomination storage returns to the storage.

7. The money processing device of claim 5, wherein
the threshold is one or more.

8. The money processing device of claim 1, further comprising:
a wrong denomination storage that stores the wrong denomination money; and
a withdrawal dispenser that dispenses the money to be withdrawn, wherein
in a withdrawal process in which the money fed from the storage is recognized by the recognition circuitry and transported to the withdrawal dispenser according to a recognition result of the recognition circuitry, the processing circuitry controls the path so that the wrong denomination money is transported to the wrong denomination storage.

9. The money processing device of claim 1, further comprising:
a wrong denomination storage that stores the wrong denomination money; and a collection storage that stores the money to be collected, wherein in a collection process in which the money fed from the storage is recognized by the recognition circuitry and transported to the collection storage according to a recognition result of the recognition circuitry, the processing circuitry controls the path so that the wrong denomination money is transported to the wrong denomination storage.

10. The money processing device of claim 1, further comprising:

a wrong denomination storage that stores the wrong denomination money; and a load storage that is loaded with the money, wherein in a loading process in which the money fed from the storage is recognized by the recognition circuitry and transported to the load storage according to a recognition result of the recognition circuitry, the processing circuitry controls the path so that the wrong denomination money is transported to the wrong denomination storage.

11. The money processing device of claim 1, wherein when the processing circuitry outputs the information on the storage abnormality of the storage, the processing circuitry changes the set denomination assigned to the storage to the denomination of the wrong denomination money.

12. A money processing device, comprising:

a storage that stores and feeds money;

a path that transports the money fed from the storage;

recognition circuitry configured to recognize a denomination of the money transported by the path; and processing circuitry configured to output information on a storage abnormality of the storage based on information on wrong denomination money, the wrong denomination money being money whose denomination recognized by the recognition circuitry does not match a set denomination assigned to the storage as a denomination of money that is supposed to be stored in the storage, wherein the information on the wrong denomination money includes information on a number of pieces of the wrong denomination money, the processing circuitry outputs the information on the storage abnormality of the storage when the number of pieces of the wrong denomination money is larger than a predetermined threshold, and the threshold is set to a value according to a storage capacity of a transport destination of the wrong denomination money.

13. A money processing device, comprising:

a storage that stores and feeds money;

a path that transports the money fed from the storage;

recognition circuitry configured to recognize a denomination of the money transported by the path;

processing circuitry configured to output information on a storage abnormality of the storage based on information on wrong denomination money, the wrong denomination money being money whose denomination recognized by the recognition circuitry does not match a set denomination assigned to the storage as a denomination of money that is supposed to be stored in the storage;

a wrong denomination storage that stores the wrong denomination money, wherein in a reconciliation process in which the money fed from the storage is recognized by the recognition circuitry, the processing circuitry controls the path so that the wrong denomination money is transported to the wrong denomination storage; and a dispenser that dispenses the money, wherein when the processing circuitry outputs the information on the storage abnormality of the storage, the processing circuitry controls the path so that the wrong denomination money fed from the wrong denomination storage is transported to the dispenser.

* * * * *